US011649130B2

(12) United States Patent
Uchibori

(10) Patent No.: US 11,649,130 B2
(45) Date of Patent: May 16, 2023

(54) MEDIUM TRANSPORTING APPARATUS, MEDIUM PROCESSING APPARATUS, AND RECORDING SYSTEM

(71) Applicant: SEIKO EPSON CORPORATION, Tokyo (JP)

(72) Inventor: Kenji Uchibori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 16/583,909

(22) Filed: Sep. 26, 2019

(65) Prior Publication Data

US 2020/0102174 A1 Apr. 2, 2020

(30) Foreign Application Priority Data

Sep. 28, 2018 (JP) ..... JP2018-183525

(51) Int. Cl.
*B65H 29/38* (2006.01)
*B65H 29/22* (2006.01)

(52) U.S. Cl.
CPC ..... *B65H 29/38* (2013.01); *B65H 29/22* (2013.01)

(58) Field of Classification Search
CPC ..... B65H 29/22; B65H 29/38; B65H 29/40; B65H 31/26; B65H 31/34; B65H 31/36; B65H 2301/4222; B65H 2301/4223
See application file for complete search history.

(56) References Cited

U.S. PATENT DOCUMENTS

| | | | | |
|---|---|---|---|---|
| 10,023,419 | B1 * | 7/2018 | Taki | B65H 31/36 |
| 2020/0087095 | A1 * | 3/2020 | Nakahata | B65H 31/3063 |
| 2020/0101768 | A1 * | 4/2020 | Kondo | B65H 31/36 |

FOREIGN PATENT DOCUMENTS

| | | | | |
|---|---|---|---|---|
| JP | 63-139239 | | 9/1988 | |
| JP | 2010-006530 | A | 1/2010 | |
| JP | 2010-208716 | | 8/2010 | |
| JP | 2013010577 | A * | 1/2013 | B65H 29/70 |
| JP | 2013-209173 | | 10/2013 | |

* cited by examiner

*Primary Examiner* — Howard J Sanders
(74) *Attorney, Agent, or Firm* — Workman Nydegger

(57) ABSTRACT

A medium transporting apparatus includes a first tray on which a medium discharged with a pair of discharge rollers that discharges a medium is mounted, a guide member that contacts the medium, which is discharge with the pair of discharge rollers, from above, and that guides the medium to the first tray, and a width direction matching member that matches an end portion of the medium, which has been discharged on the first tray, in the width direction that intersects a discharge direction of the medium. The guide member and the width direction matching member move in the width direction in an interlocked manner.

2 Claims, 16 Drawing Sheets

MEDIUM TRANSPORTING APPARATUS, MEDIUM PROCESSING APPARATUS, AND RECORDING SYSTEM

The present application is based on, and claims priority from JP Application Serial Number 2018-183525, filed Sep. 28, 2018, the disclosure of which is hereby incorporated by reference herein in its entirety.

BACKGROUND

1. Technical Field

The present disclosure relates to a medium transporting apparatus that transports a medium, a medium processing apparatus that includes the medium transporting apparatus, and a recording system including the medium transporting apparatus.

2. Related Art

There are medium processing apparatuses that perform a stapling process, a punching process, and the like on a medium. For example, there is a medium processing apparatus that includes a medium transporting apparatus that matches and stacks end portions of transported mediums in a medium tray, and that performs processes such as a stapling process and the like on the mediums stacked on the medium tray. Note that such a medium processing apparatus is, in some cases, incorporated in a recording system that is capable of performing, in a sequential manner, a recording on a medium with a recording apparatus, a representative example thereof being an ink jet printer, and post-processes such as a stapling process and the like on the medium on which recording has been performed.

Regarding the medium transporting apparatus that matches the end portions of the mediums and stacks the mediums on the medium tray, there is one in JP-A-2010-6530, for example, including a medium tray on which a medium discharged from a discharge portion is mounted, width direction matching portions that move in a width direction that intersects a medium discharge direction and that match the end portions of the medium in the width direction mounted on the medium tray, an upstream matching portion that matches the end portion of the medium mounted on the medium tray at a portion upstream in the medium discharge direction of the discharge portion, and paddles that come into contact with the medium on the medium tray and that rotate to send the medium towards an upstream matching portion. The end portions of the medium in the width direction are matched with the width direction matching portions that move in the width direction, and the upper end portion of the medium is matched by having the paddles abut the medium against the upstream matching portion. Note that in JP-A-2010-6530, the discharge portion is a discharge roller 54, the medium tray is a loading tray 50, the width direction matching portion is a matching member 52, and the upstream matching portion is a stopper 53.

In such a medium transporting apparatus, there are cases in which the medium discharged on the medium tray becomes curled. When the medium is curled on the medium tray, the matching of the end portions of the medium in the width direction and the upstream end portion in the transport direction may not be performed appropriately. Accordingly, there are cases in which guide members that press the medium, which has not been matched and which has been discharged on the medium tray, from above the medium tray and that guide the medium to the medium tray are provided.

When the medium transporting apparatus is configured to transport a plurality of sizes of mediums and when a different guide member is provided for each medium size, the number of parts increases and leads to increase in cost and increase in size of the apparatus. Furthermore, by providing guide members at positions that match the medium with the smallest size so as to provide guide members that can oppose mediums of all sizes that can be transported with the medium transporting apparatus, various sizes of mediums can be guided with the common guide members; however, the positions in the width direction that are suitable for guiding the medium may differ according to the width size of the medium. For example, when a large-sized medium is held with guide members provided at positions corresponding to a small-sized medium, skewing occurs when the medium is moved with the paddles, and the end portions of the mediums may not be matched.

SUMMARY

A medium transporting apparatus of the present disclosure that overcomes the above issue includes a medium tray on which a medium discharged from a discharge portion that discharges the medium is mounted, a guide member that comes in contact with the medium that is to be discharged with the discharge portion, and that guides the medium to the medium tray, and a width direction matching member that matches an end portion of the medium, which has been discharged on the medium tray, in a width direction that intersects a discharge direction of the medium. In the medium transporting apparatus, the guide member and the width direction matching member move in the width direction in an interlocked manner.

DESCRIPTION OF EXEMPLARY EMBODIMENTS

Figure 1:
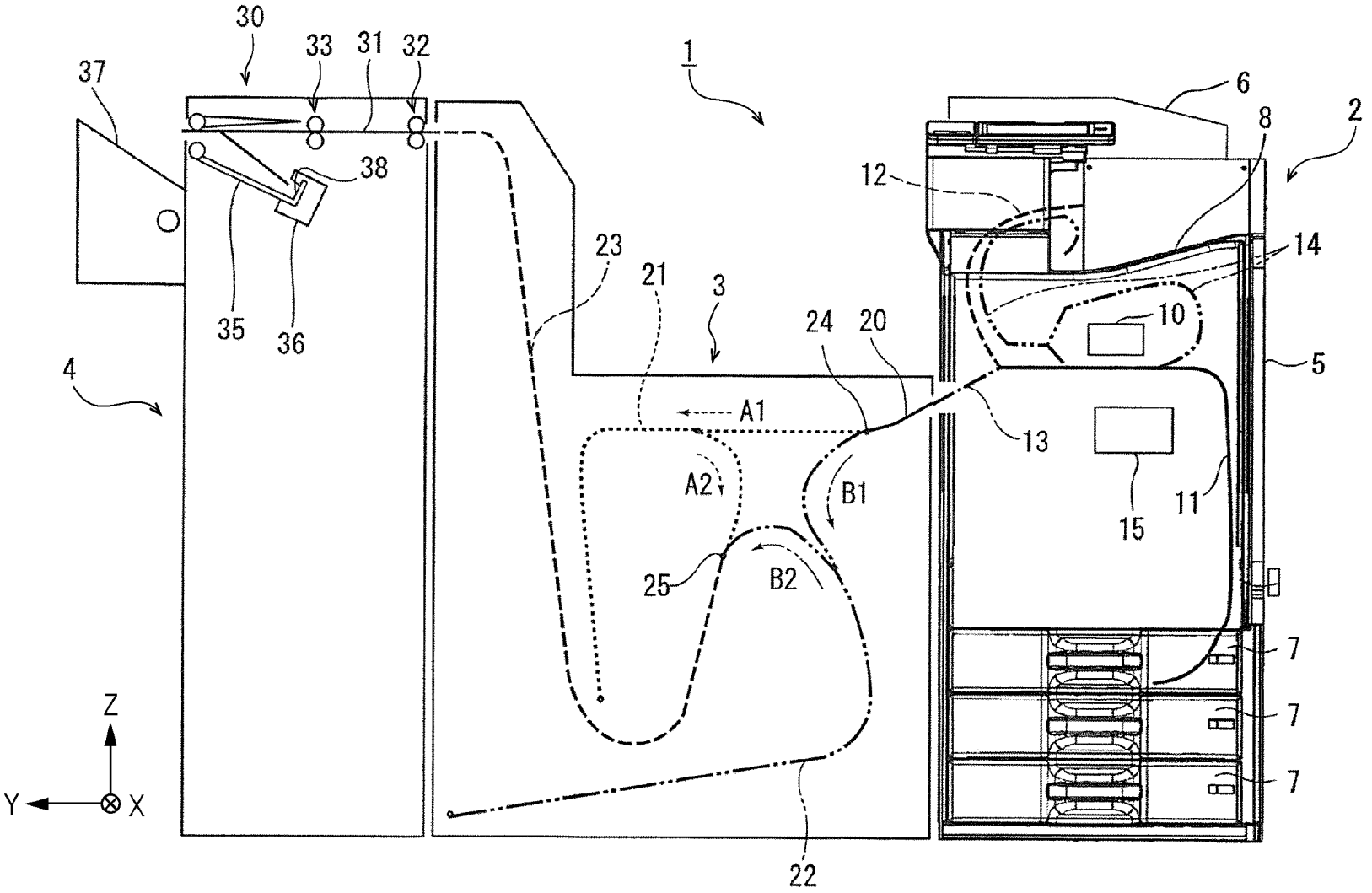
FIG. 1 is a schematic view of a recording system according to a first embodiment.

Hereinafter, the present disclosure will be described in a schematic manner.

A medium transporting apparatus according to a first aspect includes a medium tray on which a medium discharged from a discharge portion that discharges the medium is mounted, a guide member that comes in contact with the medium that is to be discharged with the discharge portion, and that guides the medium to the medium tray, and a width direction matching member that matches an end portion of the medium, which has been discharged on the medium tray, in a width direction that intersects a discharge direction of the medium, in which the guide member and the width direction matching member move in the width direction in an interlocked manner.

According to the present aspect, since the guide member and the width direction matching member move in an interlocked state, the guide member and the width direction matching member can be disposed at appropriate positions in the width direction according to the size of the medium; accordingly, guiding of the medium with the guide member and the matching of the end portion of the medium in the width direction with the width direction matching member can both be performed appropriately. Since the present aspect can correspond to a plurality of sizes of mediums with a common guide member and a common width direction matching member, an increase in the number of parts and an increase in the cost or an increase in the size of the apparatus due to the increase in the number of parts can be suppressed.

In a second aspect according to the first aspect, the guide member is configured to switch between a retracted position that does not interrupt discharge of the medium discharged with the discharge portion and an advanced position in which the guide member is, relative to the retracted position, advanced in a direction approaching the medium tray. The guide member is positioned at the retracted position when the medium is transported in the discharge direction with the discharge portion and the guide member is displaced from the retracted position to the advanced position when the medium that has been discharged from the discharge portion is guided to the medium tray.

According to the present aspect, the guide member is configured to switch between a retracted position that does not interrupt discharge of the medium discharged with the discharge portion and an advanced position in which the guide member is, relative to the retracted position, advanced in a direction approaching the medium tray, the guide member is positioned at the retracted position when the medium is transported in the discharge direction with the discharge portion and the guide member is displaced from the retracted position to the advanced position when the medium that has been discharged from the discharge portion is guided to the medium tray; accordingly, the medium that is discharged from the discharge portion can be appropriately guided to the medium tray.

A third aspect according to the second aspect further includes an upstream end matching member that matches an upstream end portion of the medium, which has been discharged to the medium tray, in the discharge direction, and a paddle that comes in contact with the medium, which has been discharged to the medium tray, and that rotates. The paddle moves the medium towards the upstream end matching member. The paddle being interlocked with movements of the guide member and the width direction matching member moves in the width direction.

According to the present aspect, the medium can be abutted against the upstream end matching member and the upstream end portion of the medium can be matched by moving the medium towards the upstream end matching member with the paddle. Since the paddle moves in the width direction while being interlocked with the movements of the guide member and the width direction matching member, the paddle can be disposed at an appropriate position in the width direction corresponding to the size of the medium and, accordingly, the paddle can appropriately move the medium.

In a fourth aspect according to the third aspect, the width direction matching member, the guide member, and the paddle are provided on both sides with respect to a center in the width direction and are, in the width direction, disposed from an outside towards the center in an order of the width direction matching member, the guide member, and the paddle.

In the present aspect, the width direction matching member, the guide member, and the paddle are provided on both sides with respect to a center in the width direction and are, in the width direction, disposed from an outside towards the center in an order of the width direction matching member, the guide member, and the paddle; accordingly, the matching of the end portion of the medium in the width direction with the width direction matching member, and the guiding of the medium with the guide member, and the moving of the medium towards the upstream end matching member with the paddle can be performed appropriately. By disposing the paddle inside the guide member, the medium can be moved with the paddle while reliably suppressing curling of the medium.

In a fifth aspect according to the fourth aspect, the width direction matching member is configured to perform a matching operation that matches an end portion of the medium in the width direction by moving from a first position that is positioned outside the medium, which is mounted on the medium tray, in the width direction to a second position that is positioned inside the first position in the width direction, and the guide member and the paddle are configured to be switched to a state in which the guide member and the paddle are not interlocked with the movement of the width direction matching member when the matching operation is performed.

According to the present aspect, the guide member and the paddle can be configured not to move in an interlocked manner with the width direction matching member moving to perform the matching operation.

In a sixth aspect according to the third to fifth aspect, the width direction matching member, the guide member, and the paddle are disposed at positions that do not overlap each other in plan view.

According to the present aspect, the width direction matching member, the guide member, and the paddle are disposed at positions that do not overlap each other in plan view; accordingly, interference between the above members can be suppressed.

A medium processing apparatus according to a seventh aspect includes the medium transporting apparatus according to any one of the first to sixth aspect, and a processing portion that performs a predetermined process on the medium transporting apparatus mounted on the medium tray.

According to the present aspect, an effect similar to those of the first to sixth aspects can be obtained with the medium processing apparatus that includes the processing portion that performs the predetermined process on the medium mounted on the medium tray of the medium transporting apparatus.

A recording system according to an eighth aspect includes a recording unit that includes a recording member that performs recording on a medium, and a processing unit including a medium transporting apparatus according to any one of the first to sixth aspect, the medium transporting apparatus transporting the medium on which recording has been performed in the recording unit, and a processing portion that performs a predetermined process on the medium mounted on the medium tray.

According to the present aspect, an effect similar to those of the first to sixth aspects can be obtained with the recording unit that includes the recording member that performs recording on the medium, and the processing unit including the medium transporting apparatus, the medium transporting apparatus transporting the medium on which recording has been performed in the recording unit, and the processing portion that performs a predetermined process on the medium mounted on the medium tray.

First Embodiment

Hereinafter, a description of a first embodiment will be given with reference to the drawings. In the X-Y-Z coordinate system in each of the drawings, the X-axis direction is a width direction of a medium and indicates a depth direction of the apparatus, the Y-axis direction indicates a width direction of the apparatus, and the Z-axis direction indicates a height direction of the apparatus.

Outline of Recording System

A recording system 1 illustrated in FIG. 1 serving as an example includes, from the right side towards the left side in FIG. 1, a recording unit 2, an intermediate unit 3, and a processing unit 4.

The recording unit 2 includes a line head 10 serving as a "recording member" that performs recording on a medium. The intermediate unit 3 receives the medium on which recording has been performed from the recording unit 2 and delivers the medium to the processing unit 4. The processing unit 4 includes a medium transporting apparatus 30 that transports the medium on which recording has been performed in the recording unit 2, and a processing portion 36 that performs a predetermined process on the medium mounted on a first tray 35 in the medium transporting apparatus 30.

In the recording system 1, the recording unit 2, the intermediate unit 3, and the processing unit 4 are coupled to each other and are configured to transport the medium from the recording unit 2 to the processing unit 4.

The recording system 1 is configured so that a recording operation, which is performed on the medium with the recording unit 2, the intermediate unit 3, and the processing unit 4, and other operations can be input from an operation panel (not shown). The operation panel can be, as an example, provided in the recording unit 2.

Hereinafter, outlines of the configurations of the recording unit 2, the intermediate unit 3, and the processing unit 4 will be described in the above order.

Regarding Recording Unit

The recording unit 2 illustrated in FIG. 1 is configured as a multifunction machine that includes a printer unit 5 and a scanner unit 6. The printer unit 5 includes the line head 10 (the recording member) that performs recording by ejecting ink, which is a liquid, to the medium. In the present embodiment, the printer unit 5 is configured as a so-called ink jet printer that performs printing by ejecting ink, which is a liquid, to the medium from the line head 10.

A plurality of medium storage cassettes 7 are provided in an apparatus lower portion of the recording unit 2. The recording operation is performed by having the medium stored in one of the medium storage cassettes 7 pass through a feeding path 11 depicted by a solid line in the recording unit 2 in FIG. 1 and by having the medium be sent to an area in which recording is performed by the line head 10. The medium on which recording has been performed with the line head 10 is sent either to a first discharge path 12 that is a path through which the medium is discharged to a post-recording discharge tray 8 provided above the line head 10 or to a second discharge path 13 that is a path through which the medium is sent to the intermediate unit 3. In the recording unit 2 in FIG. 1, the first discharge path 12 is depicted with a broken line and the second discharge path 13 is depicted with a dot and dash line.

Furthermore, the recording unit 2 includes a reversing path 14 depicted by a two-dot chain line in the recording unit 2 in FIG. 1 and is configured to perform a double-sided recording that performs recording on a second surface of the medium after performing recording on a first surface and reversing the medium.

One or more pairs of transport rollers (not shown) that are examples of members that transport the medium are disposed in each of the feeding path 11, the first discharge path 12, the second discharge path 13, and the reversing path 14.

A control unit 15 that controls operations related to the transport and the recording of the medium in the recording unit 2 is provided in the recording unit 2.

Regarding Intermediate Unit

The intermediate unit 3 illustrated in FIG. 1 is disposed between the recording unit 2 and the processing unit 4. The intermediate unit 3 is configured to receive, through a receiving path 20, the medium on which recording has been performed sent from the second discharge path 13 of the recording unit 2 and to transport the medium to the processing unit 4. The receiving path 20 is depicted by a solid line in the intermediate unit 3 illustrated in FIG. 1.

In the intermediate unit 3, there are two transport paths that transport the medium. The first transport path is a path through which the medium is transported from the receiving path 20 to a discharge path 23 through a first switchback path 21. The second path is a path through which the medium is transported from the receiving path 20 to the discharge path 23 through a second switchback path 22.

The first switchback path 21 is a path through which the medium is, after being received in an arrow A1 direction, switched back in an arrow A2 direction. The second switchback path 22 is a path through which the medium is, after being received in an arrow B1 direction, switched back in an arrow B2 direction.

The receiving path 20 is branched into the first switchback path 21 and the second switchback path 22 at a branching portion 24. Furthermore, the first switchback path 21 and the second switchback path 22 are merged at a merging portion 25. Accordingly, the medium sent from the receiving path 20 through either of the switchback paths can be delivered to the processing unit 4 through the common discharge path 23.

One or more pairs of transport rollers (not shown) are disposed in each of the receiving path 20, the first switchback path 21, the second switchback path 22, and the discharge path 23.

When recording is performed continuously on a plurality of mediums in the recording unit 2, the mediums that have entered the intermediate unit 3 are alternately sent to the transport path passing through the first switchback path 21 and the transport path passing through the second switchback path 22. With the above, the throughput of medium transportation in the intermediate unit 3 can be increased.

Note that the recording system 1 can be configured without the intermediate unit 3. In other words, a configuration in which the recording unit 2 and the processing unit 4 are coupled to each other, and the medium on which recording has been performed in the recording unit 2 is directly sent to the processing unit 4 without passing through the intermediate unit 3 can be provided.

As in the present embodiment, when the medium on which recording has been performed in the recording unit 2 is sent to the processing unit 4 through the intermediate unit 3, compared with when the medium is sent directly to the processing unit 4 from the recording unit 2, the transport time is long; accordingly, the ink on the medium can be drier before the medium is transported to the processing unit 4.

Regarding Processing Unit

The processing unit 4 illustrated in FIG. 1 includes the medium transporting apparatus 30 and is configured so that the processing portion 36 performs a process on the medium transported in the medium transporting apparatus 30. Examples of the processes performed by the processing portion 36 includes a stapling process and a punching process.

The medium is delivered to a transport path 31 of the processing unit 4 from the discharge path 23 of the intermediate unit 3 and is transported with the medium transporting apparatus 30. A pair of transport rollers 32 that transport the medium are provided upstream of the transport path 31 in a transport direction (+Y direction). Furthermore, a pair of discharge rollers 33 serving as a "discharge portion" that discharges the medium to the first tray 35 described later is provided downstream of the transport path 31 in the transport direction.

Regarding Medium Transporting Apparatus

Referring hereinafter to the drawings, a detailed description of the medium transporting apparatus 30 will be given.

Figure 2:
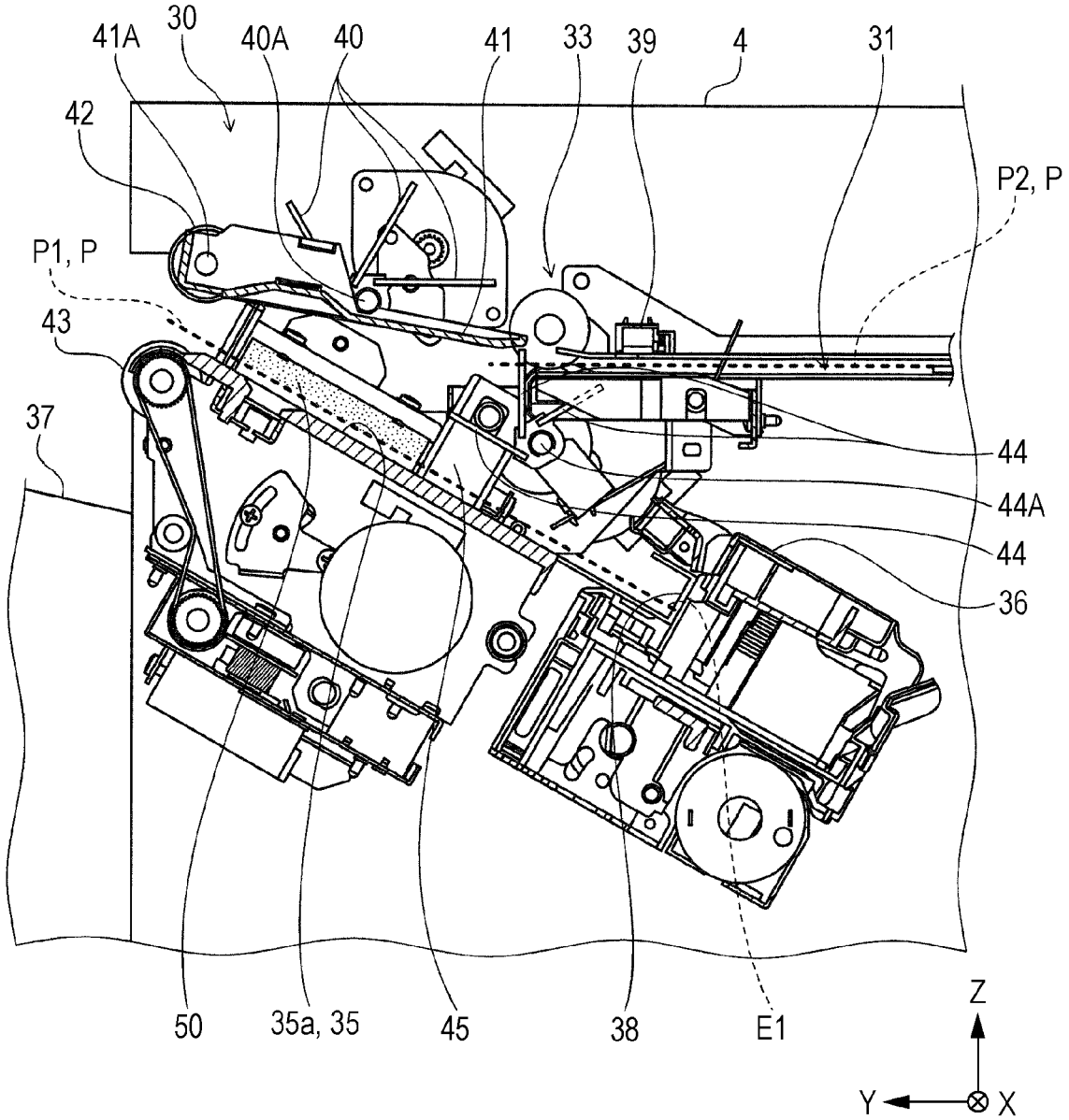
FIG. 2 is a sectional side view of the medium transporting apparatus according to the first embodiment.

The medium transporting apparatus 30 illustrated in FIG. 2 includes the first tray 35 and paddles 40. The first tray 35 serving as a "medium tray" mounts thereon a medium P discharged with the pair of discharge rollers 33, and includes upstream end matching members 38 serving as "matching portions" that match trailing edges E1 of the mediums P at portions upstream in a discharge direction (the +Y direction) of the pair of discharge rollers 33. The paddles 40 come in contact with the medium P discharged on the first tray 35, rotate, and move the medium P towards the upstream end matching member 38.

The pair of discharge rollers 33 discharge the medium P in the discharge direction that extends substantially towards the +Y direction.

Figure 3:
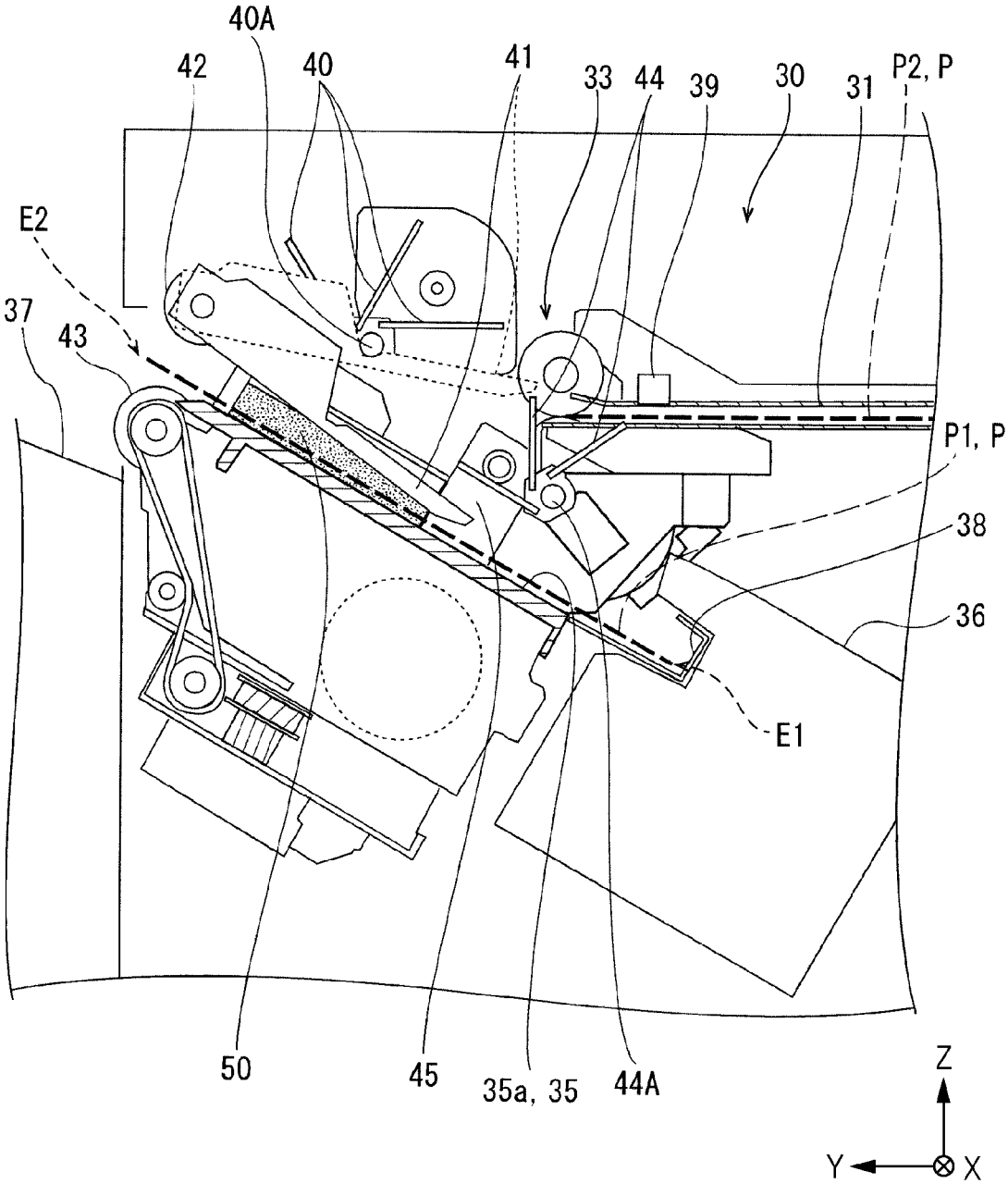
FIG. 3 is a schematic sectional side view of the medium transporting apparatus according to the first embodiment.

Guide members 41 that come in contact with the medium P, which is discharged with the pair of discharge rollers 33, from above and that guide the medium P to the first tray 35 are provided above the first tray 35. The guide members 41 are configured to be displaced between, as illustrated in FIG. 2, a retracted position that does not interrupt the discharge of the medium P discharged with the pair of discharge rollers 33, and as illustrated in FIG. 3, an advanced position in which the guide members 41 are, relative to the retracted position, advanced in a direction approaching the first tray 35. In FIG. 3, the guide member 41 in the retracted position is depicted by a broken line. When the medium P is transported in the discharge direction with the pair of discharge rollers 33, the guide members 41 are positioned in the retracted position illustrated in FIG. 2, and when the medium P discharged from the pair of discharge rollers 33 is guided to the first tray 35, the guide members 41 are displaced from the retracted position illustrated by a broken line in FIGS. 2 and 3 to the advanced position illustrated by a solid line in FIG. 3.

Figure 4:
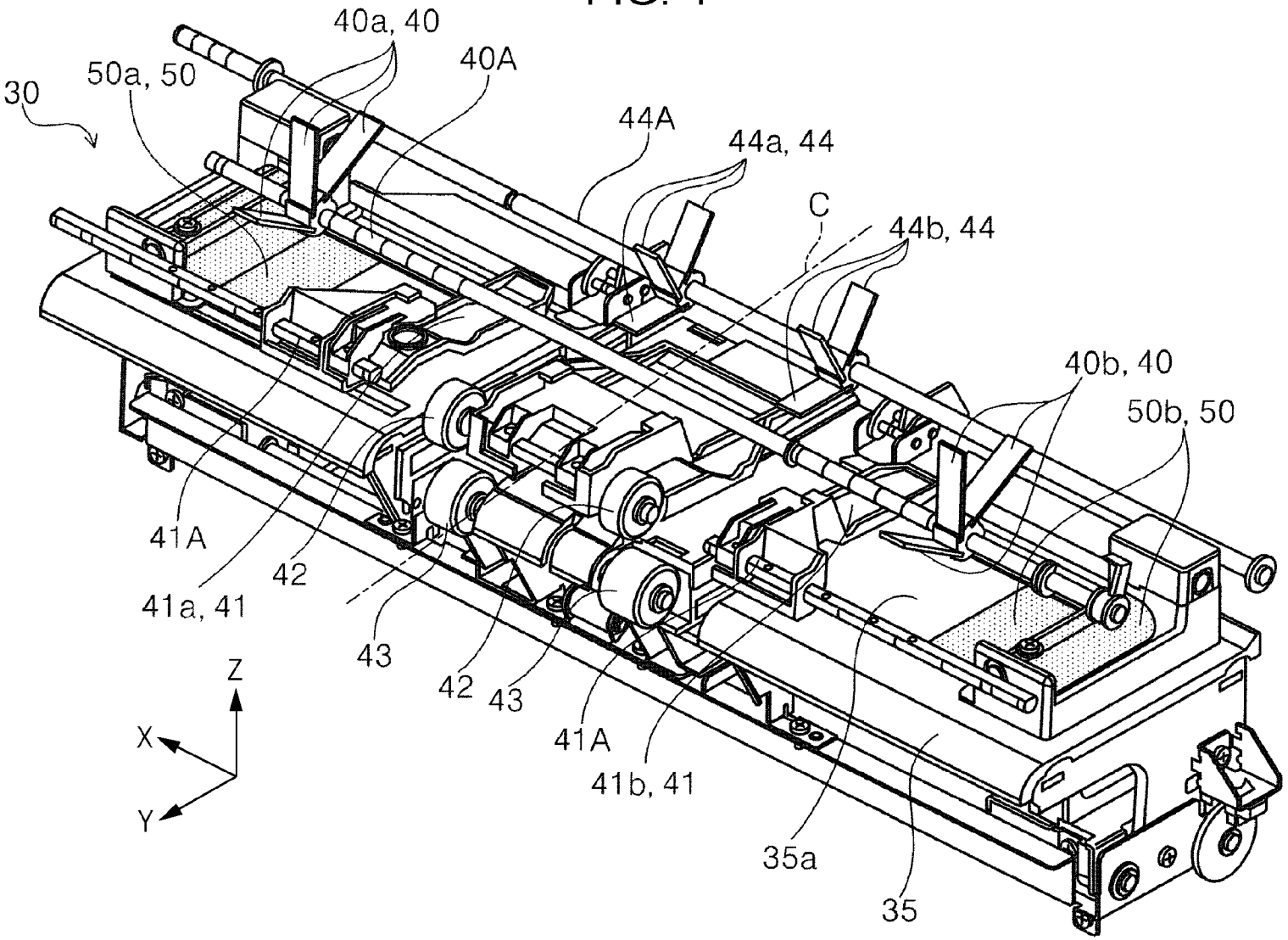
FIG. 4 is a perspective view of the medium transporting apparatus according to the first embodiment.

As illustrated in FIGS. 2 and 3, the paddles 40 and the guide members 41 overlap each other in the discharge direction of the medium P and, as illustrated in FIG. 4, are at positions shifted with respect to each other in the X-axis direction that is the width direction that intersects the discharge direction. In FIG. 4, a single paddle 40 and a single guide member 41 are disposed on both sides with respect to the center C in the width direction so as to be symmetrical against the center C. A paddle 40*a* and a guide member 41*a* are provided on a +X side with respect to the center C, and a paddle 40*b* and a guide member 41*b* are provided on a −X side with respect to the center C.

Each paddle 40 includes plate-shaped members, and a plurality of plate-shape members are attached at intervals along an outer circumference of a rotation shaft 40A. A +Y side, which is downstream in the discharge direction, of each guide member 41 is attached to a pivot shaft 41A, and a −Y side of the guide member 41 is configured to pivot as a free end.

Upper rollers 42 are provided above the first tray 35 and downstream of the paddles 40 and the guide members 41 in the discharge direction of the medium P. The upper rollers 42 are rollers that, together with lower rollers 43 provided on the first tray 35 side, nip a single or a plurality of mediums P mounted on the first tray 35 to discharge the single of the plurality of mediums P to a second tray 37.

Referring to FIGS. 2 and 3, the second tray 37 that receives the medium discharged from the first tray 35 is provided in the +Y direction of the first tray 35.

The medium P discharged with the pair of discharge rollers 33 is mounted on the first tray 35. An upstream end portion of the medium P, which has been discharged on the first tray 35, in the discharge direction, in other words, the trailing edge E1 of the medium P, comes in contact with the upstream end matching members 38 and the position is matched thereto. When a plurality of mediums P are mounted on the first tray 35, the trailing edges E1 of the plurality of mediums P are matched with the upstream end matching members 38.

Figure 7:
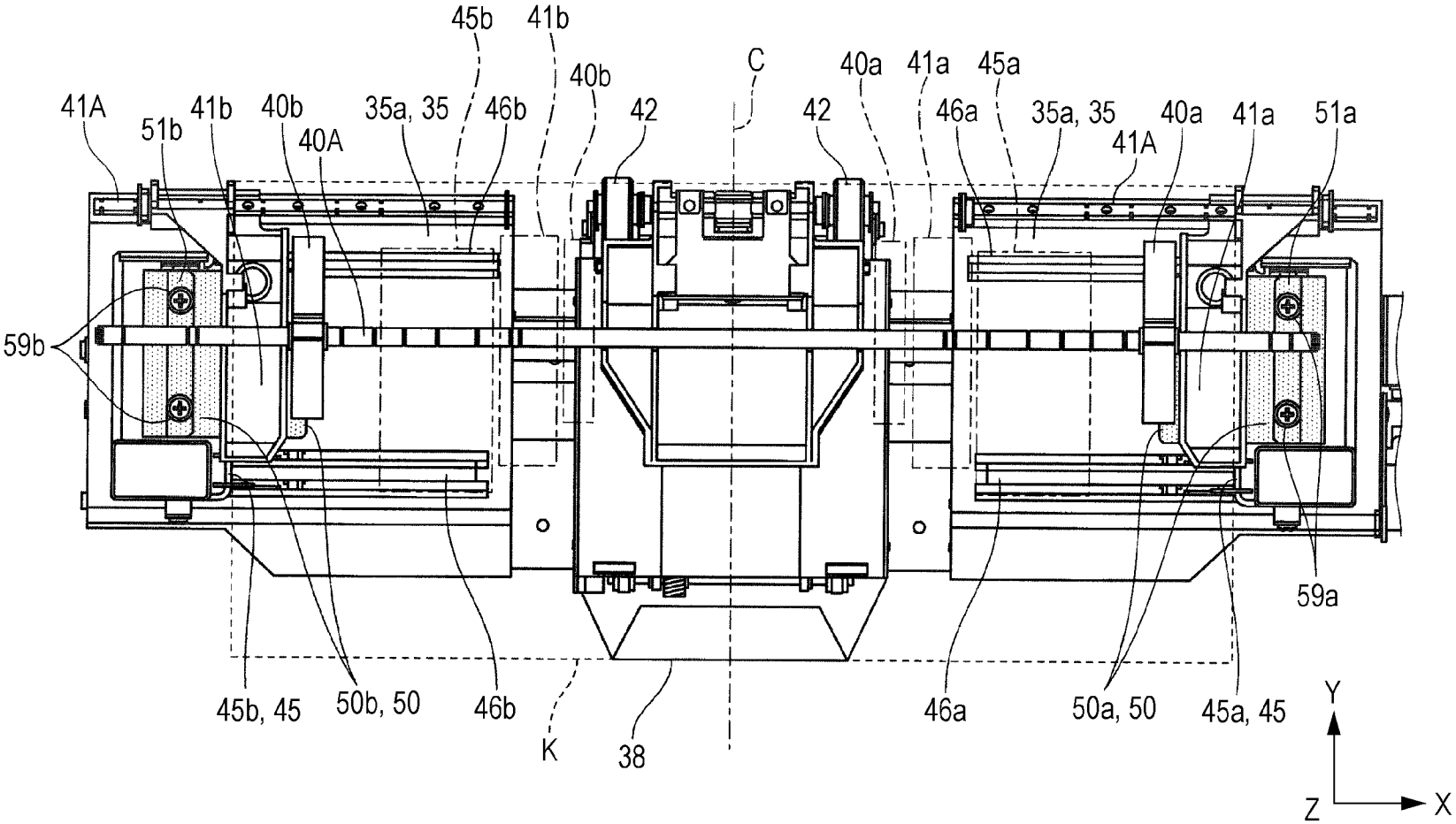
FIG. 7 is a plan view illustrating an essential portion of the medium transporting apparatus.

Furthermore, the medium transporting apparatus 30 includes width direction matching members 45 that match the end portions of the mediums P in the width direction. As illustrated in FIG. 7, the width direction matching members 45 include a first matching portion 45*a* that is provided in a +X direction, serving as a first direction in the width direction, of the first tray 35, and a second matching portion 45*b* provided in a −X direction, serving as a second direction opposite the first direction, of the first tray 35. The width direction matching members 45 match the end portions of the mediums P in the width direction by, after the mediums P have been mounted between the first matching portion 45*a* and the second matching portion 45*b*, having the first matching portion 45*a* and the second matching portion 45*b* move close to each other and come in contact with the end portions of the mediums P in the width direction. An operation of matching the mediums P in the width direction with the width direction matching members 45 will be described later.

Figure 5:
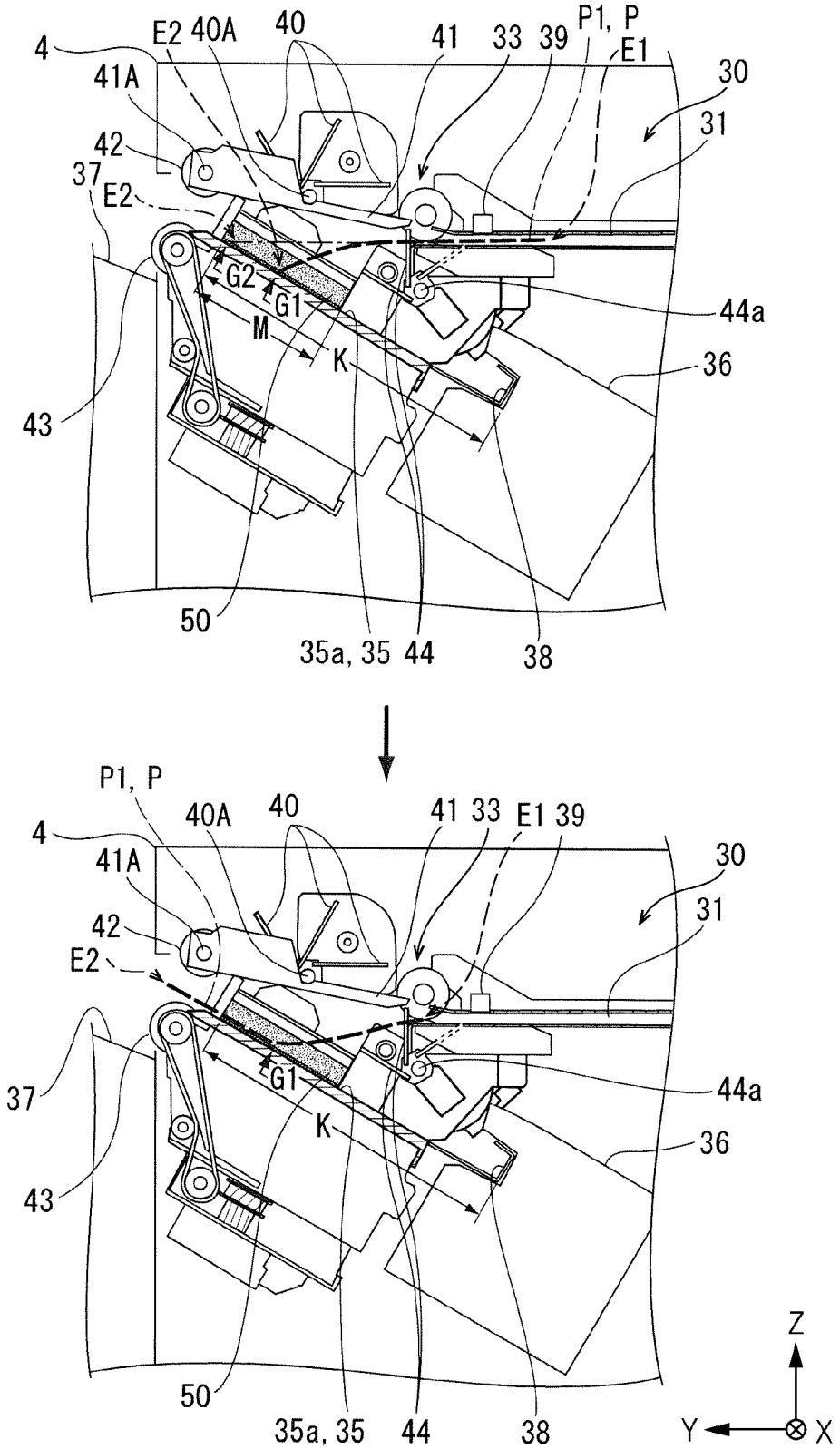
FIG. 5 is a diagram illustrating a flow until a medium discharged from a pair of discharge rollers is mounted on a first tray.
Figure 6:
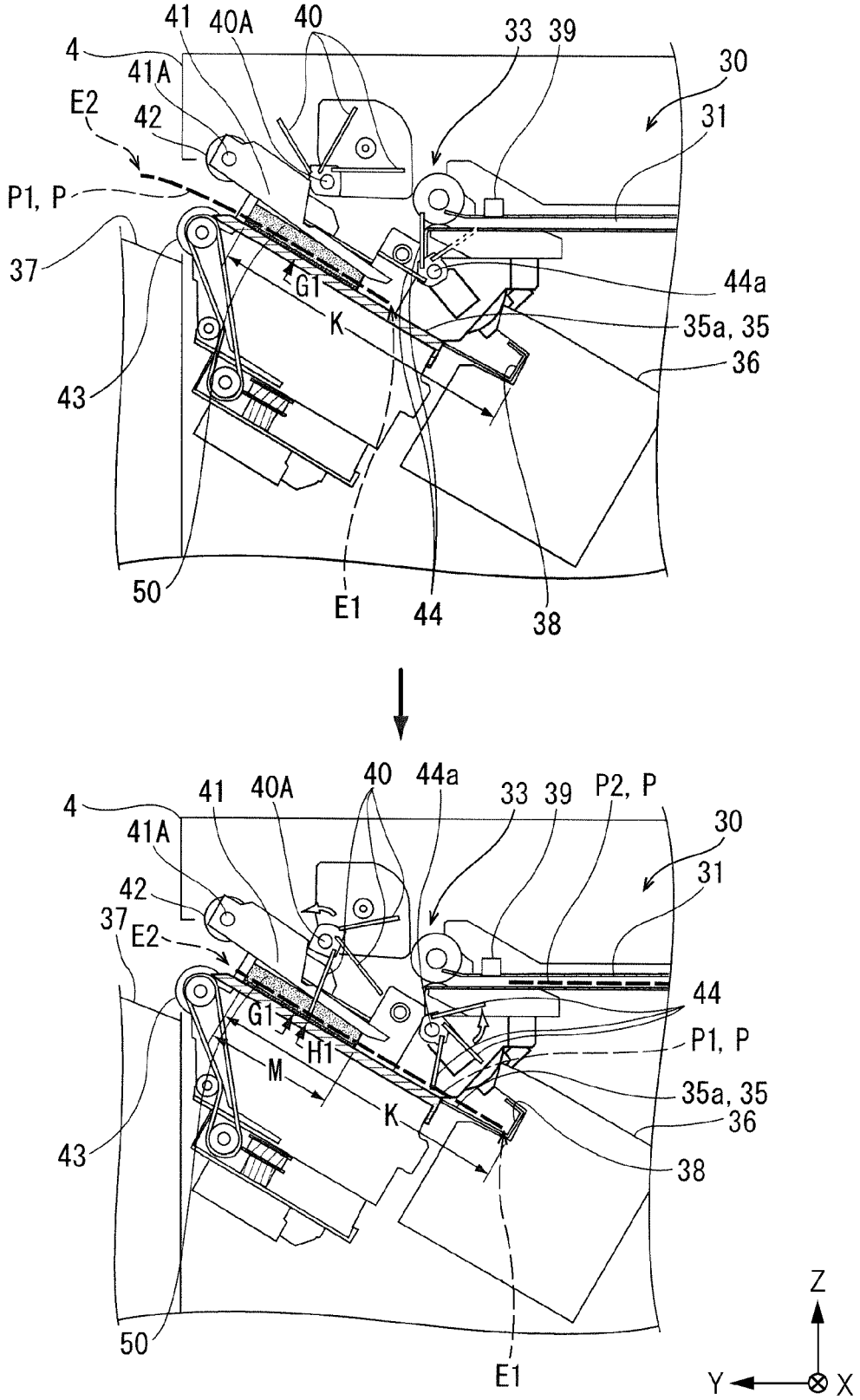
FIG. 6 is a diagram illustrating a flow until the medium discharged from the pair of discharge rollers is mounted on the first tray.

Referring next to FIGS. 5 and 6, mounting of the medium P discharged from the pair of discharge rollers 33 to the first tray 35 will be described.

The leading edge E2 of the medium P discharged from the pair of discharge rollers 33 lands on a mount surface 35*a* in the first tray 35 as illustrated in the upper drawing in FIG. 5. A landing position of the medium P differs according to the stiffness and the size of the medium P. A position G2 in the upper drawing in FIG. 5 illustrates a position on the mount surface 35*a* where the medium P lands when an leading edge E2 of the medium P does not hang down. When the stiffness of the medium P is high, the medium P moves straight in the discharge direction and lands on the mount surface 35*a* at position G2. On the other hand, for example, the leading edges E2 of plain paper and thin paper that has stiffness lower than that of plain paper hang down. Plain paper and thin paper land at a position upstream of position G2 in the discharge direction such as a position indicated by reference numeral G1 in the upper drawing in FIG. 5.

After the leading edge E2 of the medium P has landed on the mount surface 35*a*, the medium P proceeds on the mount surface 35*a* in the discharge direction until, as illustrated in the lower drawing in FIG. 5, the trailing edge E1 becomes separated from the nip of the pair of discharge rollers 33.

While the discharge of the medium P is performed by the pair of discharge rollers 33, the guide members 41 are located at the retracted position as illustrated in the upper and lower drawings in FIG. 5 so that the guide members 41 do not interrupt the discharge of the medium P performed by the pair of discharge rollers 33.

When the trailing edge E1 of the medium P is separated from the nip of the pair of discharge rollers 33, as illustrated in the upper drawing in FIG. 6, the guide members 41 advance to the advanced position that is closer to the first tray 35 than the retracted position. The medium P falls on the mount surface 35*a* by its own weight and is reliably mounted on the mount surface 35*a* with the guide members 41 that have been displaced form the retracted position to the advanced position. With the above, the medium P discharged from the pair of discharge rollers 33 can be appropriately guided to the first tray 35.

When the medium P is mounted on the mount surface 35*a*, the paddles 40 rotate counterclockwise in FIG. 6. A hollow arrow in the lower diagram in FIG. 6 depicts the rotation direction of the paddles 40.

By having the paddles 40 in contact with the medium P rotate, the trailing edge E1 of the medium P moves in a direction extending towards the upstream end matching member 38, and the trailing edge E1 is abutted against the upstream end matching member 38. With the above, the position of the trailing edge E1 of the medium P mounted on the first tray 35 is matched with the upstream end matching member 38.

When the rotation shaft 40A is in a stopped state, the paddles 40 are, as illustrated as an example in the upper drawing in FIG. 5, located at a position that does not interrupt the discharge of the medium P with the pair of discharge rollers 33 and, as illustrated in the lower drawing in FIG. 6, with the rotation of the rotation shaft 40A, the paddles 40 come in contact with the medium P on the mount surface 35*a* and are rotated. In the present embodiment, the paddles 40 rotate a single turn for a single medium P and returns to and stops at the position illustrated in the upper drawing in FIG. 5.

Note that in the present embodiment, auxiliary paddles 44 that rotate about a rotation shaft 44A are provided below the pair of discharge rollers 33. The auxiliary paddles 44 are disposed closer to the upstream end matching members 38 than the paddles 40 and, same as the paddles 40, rotate counterclockwise in the lower drawing in FIG. 6. By providing the auxiliary paddles 44, the medium P can be abutted against and matched with the upstream end matching members 38 in a further reliable manner.

Furthermore, after rotating the paddles 40 and matching the trailing edge E1 of the medium P against the upstream end matching members 38, matching of the end portions of the medium P in the width direction is performed with the width direction matching members 45 (the first matching portion 45*a* and the second matching portion 45*b*).

Figure 13:
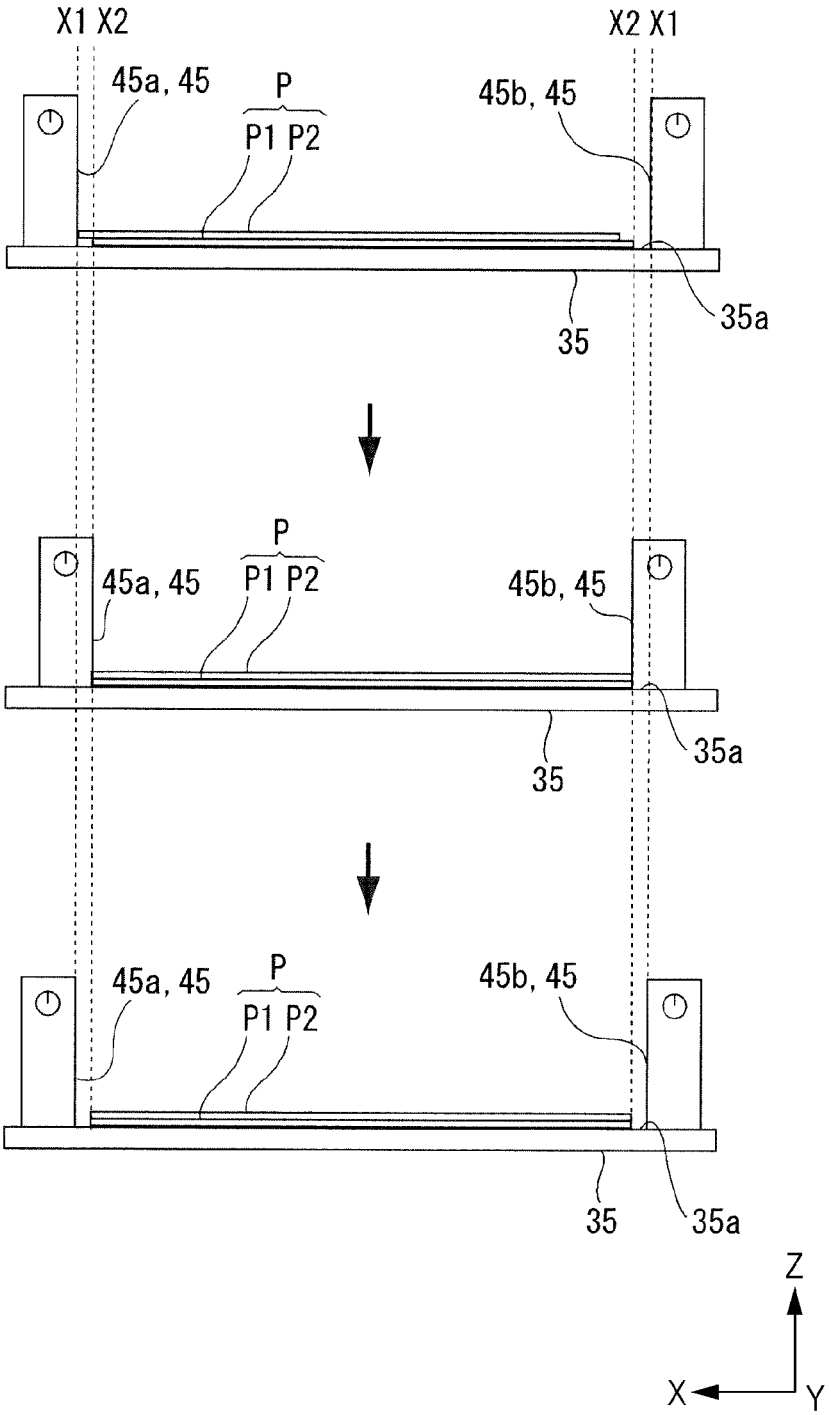
FIG. 13 is a diagram illustrating a matching operation of the width direction matching members.

The first matching portion 45*a* and the second matching portion 45*b* are configured to perform the matching operation that matches the end portions of the medium P in the width direction by moving from first positions X1 illustrated in the upper drawing in FIG. 13 that are positions outside the medium P, which is mounted on the first tray 35, in the width direction to second positions X2 illustrated in the middle drawing in FIG. 13 that are positions inside the first positions X1 in the width direction. Note that in FIG. 13, illustrations of a low frictional resistance member 50*a* provided in the first matching portion 45*a* and a low frictional resistance member 50*b* provided in the second matching portion 45*b* are omitted.

From when the discharge of the medium P from the pair of discharge rollers 33 is started until when the trailing edge E1 of the medium P is matched with the upstream end matching members 38 with the rotation of the paddles 40, the first matching portion 45*a* and the second matching portion 45*b* are, as illustrated in the upper drawing in FIG. 13, positioned at the first positions X1 outside the medium P, which is mounted on the first tray 35, in the width direction. The first positions X1 are positions in which the gap between the first matching portion 45*a* and the second matching portion 45*b* are slightly larger than the width of the medium P, which is a length that can tolerate the position aberration of the medium in the width direction and match the medium.

After matching of the trailing edge E1 of the medium P described above is performed, the first matching portion 45*a* and the second matching portion 45*b* move closer to each other and move to the second positions X2. The second positions X2 are positions where the gap between the first matching portion 45*a* and the second matching portion 45*b* is substantially the same as the width of the medium P.

By performing the above matching operation, for example, even when there is a position aberration in the width direction between a first medium P1 that has been discharged first and a second medium P2 that has been discharged afterwards, as illustrated in the upper drawing in FIG. 13, the end portions of the first medium P1 and the second medium P2 in the width direction can be matched.

After the matching operation has ended, the first matching portion 45*a* and the second matching portion 45*b* return to the first positions X1 illustrated in the lower drawing in FIG. 13 and prepare for the discharge of the next medium.

When a plurality of mediums P are continuously mounted on the first tray 35, after performing, on the first medium P1 that is discharged first, the matching of the trailing edge E1 using the paddles 40 and the matching of the end portions of both sides of the first medium P1 in the width direction with the width direction matching members 45, the guide members 41 are returned to the retracted position before the second medium P2 is discharged from the pair of discharge rollers 33. Note that it is desirable that the guide members 41 are at the advanced position until directly before the second medium P2 is discharged from the pair of discharge rollers 33. With the above, since the guide members 41 hold down the first medium P1 mounted first on the first tray 35, curling of the first medium P1 can be suppressed.

The timing at which the guide members 41 are displaced between the retracted position and the advanced position, the timing at which the paddles 40 are rotated, and the timing at which the matching operation is performed with the width direction matching members 45 can be determined based on a detection of the medium P with a medium detection member 39 provided upstream of the pair of discharge rollers 33. For example, each of the operations can be performed after a passage of a predetermined time from when the trailing edge E1 of the medium P has been detected with the medium detection member 39.

The processing portion 36, which is provided near the upstream end matching members 38, performs processes such as the stapling process on a single or a plurality of mediums P mounted on the first tray 35 after the trailing edges E1 and both end portions in the width direction have been matched in the medium transporting apparatus 30. The mediums P on which the process has been performed with the processing portion 36 are discharged from the first tray 35 to the second tray 37 with the upper rollers 42 and the lower rollers 43.

Hereinafter, the guide members 41, the width direction matching members 45, and the paddles 40 will be described in detail.

Regarding Guide Members, Width Direction Matching Members, and Paddles

In the medium transporting apparatus 30 according to the present embodiment, the guide members 41 and the width direction matching members 45 are configured to move in the width direction in an interlocked manner.

Furthermore, in the present embodiment, the paddles 40 are also configured to move in the width direction while being interlocked with the movements of the guide members 41 and the width direction matching members 45.

As illustrated in FIG. 7, the width direction matching members 45, the guide members 41, and the paddles 40 are provided on both sides with respect to the center C in the width direction, and are disposed from the outer side towards the center in the width direction in the order of the width direction matching members 45, the guide members 41, and the paddles 40.

In other words, the guide member 41*a* and the guide member 41*b* are disposed inside the first matching portion 45*a* and the second matching portion 45*b*, and the paddle 40*a* and the paddle 40*b* are disposed inside the guide member 41*a* and the guide member 41*b*.

Furthermore, the width direction matching members 45, the guide members 41, and the paddles 40 are disposed at positions that do not overlap each other in plan view Accordingly, the width direction matching members 45, the guide members 41, and the paddles 40 can be prevented from interfering each other in the height direction.

Figure 15:
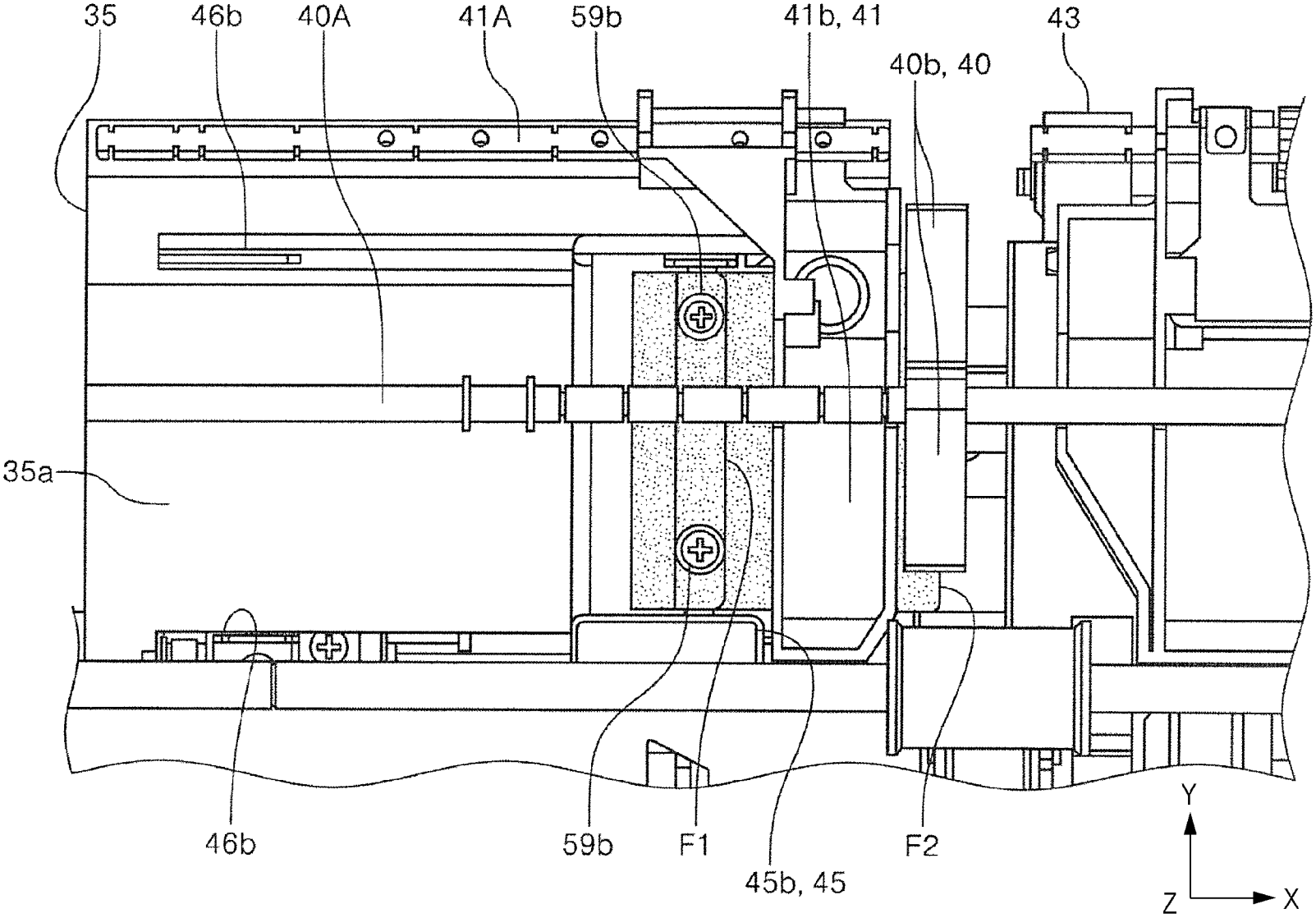
FIG. 15 is a plan view illustrating a state in which the width direction matching member is positioned on the innermost side in the width direction.

In FIG. 7, the first matching portion 45*a* and the second matching portion 45*b* depicted by solid lines illustrate a state in which the first matching portion 45*a* and the second matching portion 45*b* are positioned on the outermost side in the width direction, and the guide members 41*a* and 41*b* are disposed right inside the first matching portion 45*a* and the second matching portion 45*b*, and the paddles 40*a* and 40*b* are disposed further inside. In FIG. 7, the first matching portion 45*a* and the second matching portion 45*b* depicted by dot and dash lines illustrates a state in which the first matching portion 45*a* and the second matching portion 45*b* are positioned on the innermost side in the width direction. In the above state, the guide member 41*a* and the paddle 40*a* move inward while maintaining relative positional relationships with the first matching portion 45*a*, and the guide member 41*b* and the paddle 40*b* (see FIG. 15 as well) move inward while maintaining relative positional relationships with the second matching portion 45*b*. It goes without saying that the guide member 41*a* and the paddle 40*a* can be moved while the relative positional relationship between the first matching portion 45*a* and the guide member 41*a* or the paddle 40*a* changes. Note that FIG. 15 illustrates the second matching portion 45*b* on the −X side positioned on the innermost side in the width direction.

Note that the medium transporting apparatus 30 of the present embodiment is configured to transport mediums P of a plurality of sizes.

As in the present embodiment, when the guide members 41 and paddles 40 are provided on both sides with respect to the center C in the width direction as pairs, it is desirable that the guide members 41*a* and 41*b* and the paddles 40*a* and 40*b* are disposed close to the end portions on both sides of the medium P in the width direction. When the guide members 41*a* and 41*b* are disposed close to the end portions on both sides of the medium P in the width direction, curling of the medium P mounted on the first tray 35 can be suitably suppressed. Furthermore, it is desirable that the paddles 40*a* and 40*b* are disposed close to the end portions on both sides of the medium P in the width direction since skewing does not easily occur when the medium P moves towards the upstream end matching members 38.

By configuring the guide members 41, the paddles 40, and the width direction matching members 45 to move in an interlocked manner, the guide members 41 and the paddles 40 can be moved while being interlocked with the movements of the width direction matching members 45 corresponding to the size of the medium P; accordingly, the medium P can be disposed at a position suitable for its size. Furthermore, since the pair of guide members 41, the pair of paddles 40, and the pair of width direction matching members 45 can be made to correspond to a plurality of sizes of mediums P, compared with providing the guide members and paddles having fixed positions, an increase in the number of parts can be suppressed and the increase in cost or increase in the size of the apparatus due to the increase in the number of parts can be avoided.

Furthermore, by disposing the width direction matching members 45, the guide members 41, and the paddles 40 in that order from the outside in the width direction of the medium P, the matching of the end portion of the medium P in the width direction with the width direction matching members 45, the guiding of the medium P with the guide members 41, and the moving of the medium P towards the upstream end matching members 38 with the paddles 40 can each be performed appropriately. Furthermore, by disposing the paddles 40 inside the guide members 41, the medium P can be moved with the paddles 40 while reliably suppressing curling of the end portions of the medium P in the width direction.

Furthermore, low frictional resistance members 50 are provided in the medium transporting apparatus 30. A detailed description of the low frictional resistance members 50 will be given below.

Regarding Low Frictional Resistance Members

Figure 9:
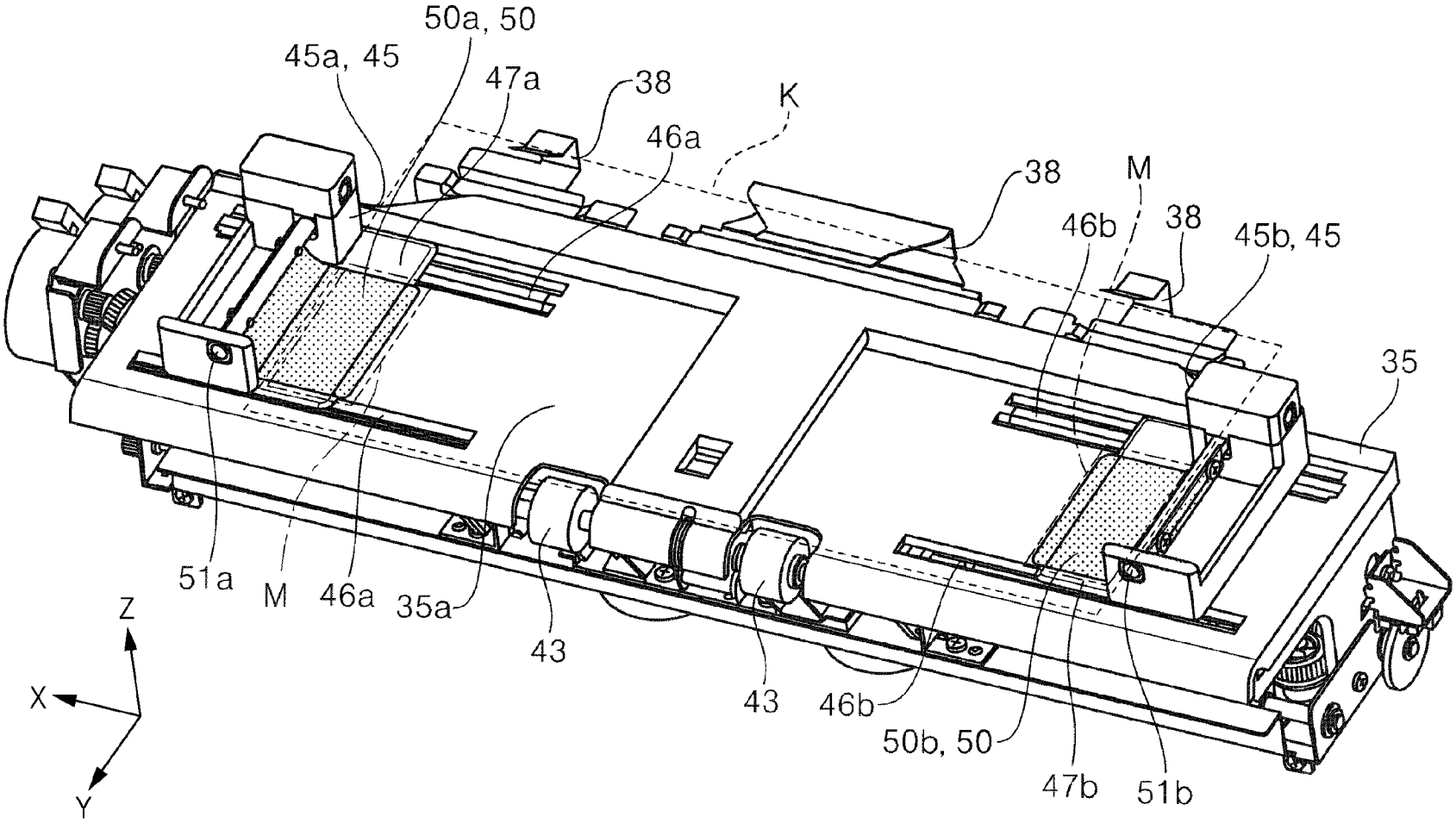
FIG. 9 is a perspective view of the first tray illustrating low frictional resistance members in an advanced state.
Figure 10:
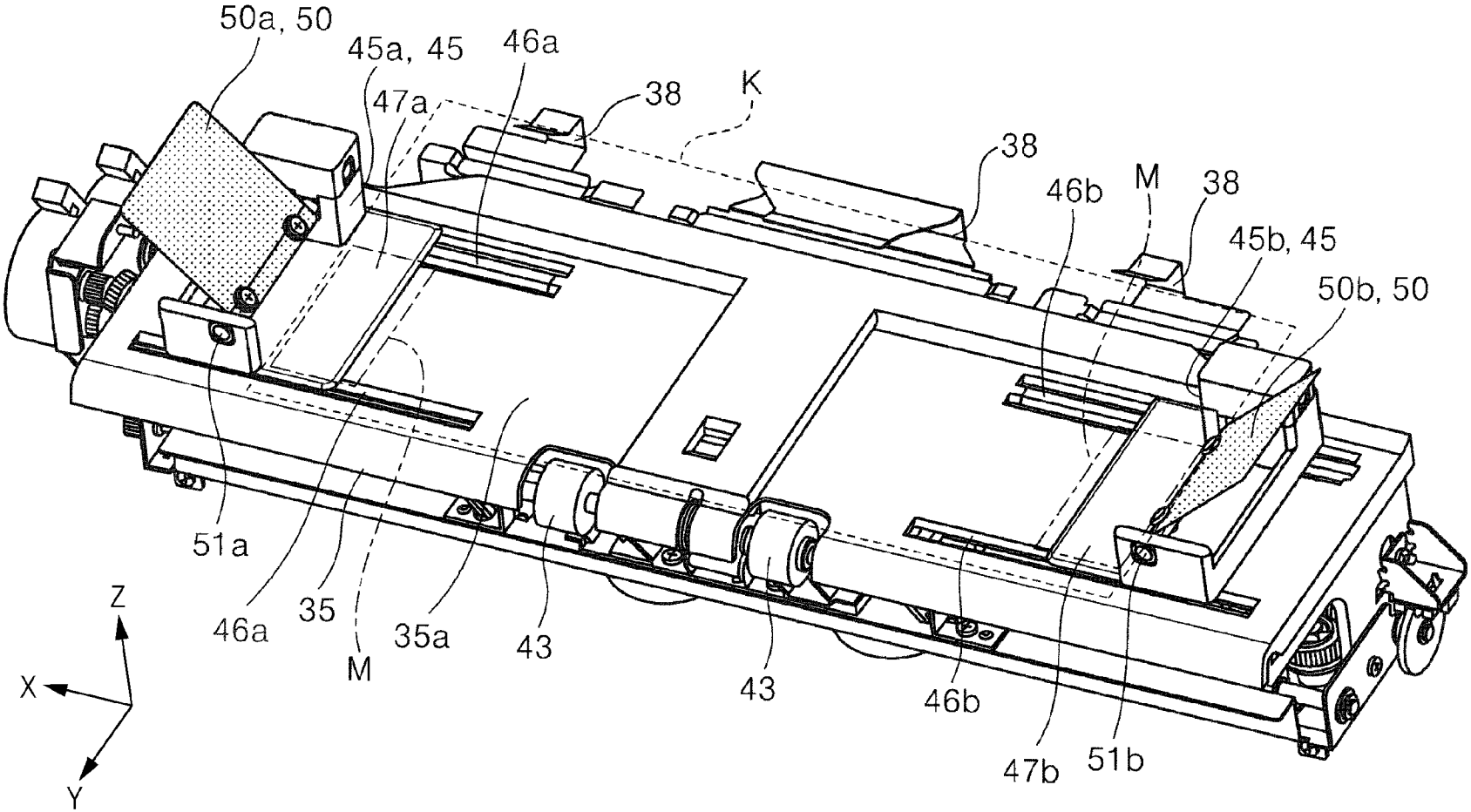
FIG. 10 is a perspective view of the first tray illustrating low frictional resistance members in a retracted state.

The low frictional resistance members 50 are configured to switch between an advanced state, as illustrated in FIG. 9, advanced from outside a medium mount region K of the first tray 35 to first regions M including the positions in the medium mount region K where the paddles 40 are in contact with the medium P (see also the lower drawing in FIG. 6), and a retracted state, as illustrated in FIG. 10, retracted from the first regions M to the outside of the medium mount region K. In the present embodiment, the low frictional resistance members 50 are provided at both end portions in the width direction and are configured of the low frictional resistance member 50*a* on the +X side and the low frictional resistance member 50*b* on the −X side.

The low frictional resistance members 50 are components in which the frictional coefficient between the low frictional resistance member 50 and the medium P is lower than the frictional coefficient between the mediums P.

In the present embodiment, the low frictional resistance members 50 are each formed in a sheet shape. A resin sheet that can be curved such as, for example, a polyethylene terephthalate (PET) sheet can be used as the sheet-shaped low frictional resistance member 50.

Figure 11:
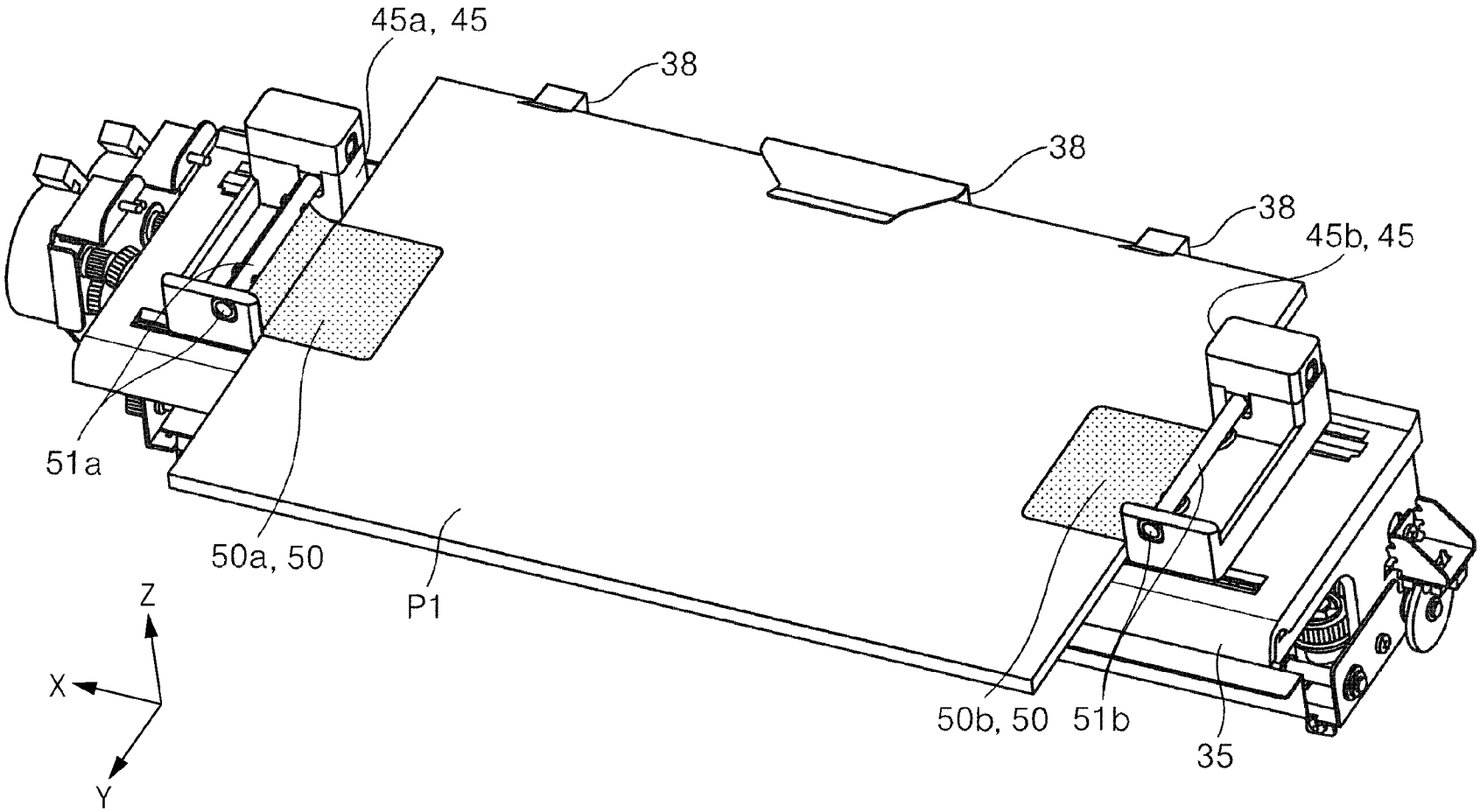
FIG. 11 is a perspective view of the first tray in which the low frictional resistance members in the advanced state are on the medium.
Figure 14:
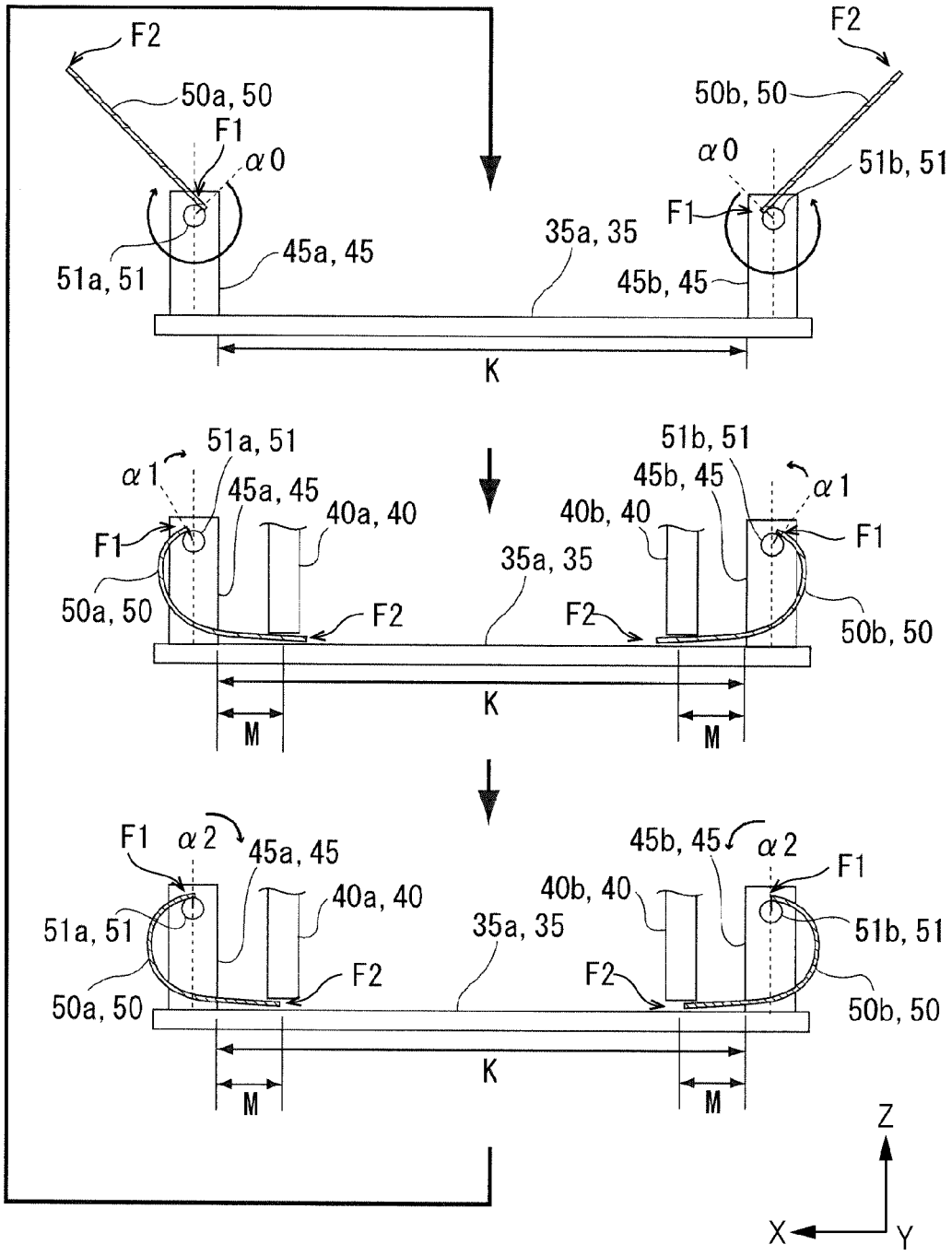
FIG. 14 is a diagram illustrating switching of the low frictional resistance members between the advanced state and the retracted state.

As illustrated in FIG. 9, the low frictional resistance members 50 are fixed to rotation shafts 51 disposed outside the medium mount region K and are switched between the advanced state illustrated in FIGS. 9 and 11 and the retracted state illustrated in FIG. 10 by rotating the rotation shafts 51 as illustrated in FIG. 14. With such a configuration, switching of the low frictional resistance members 50 between the advanced state and the retracted state can be achieved with a simple configuration. A mount configuration of the low frictional resistance member 50 will be specifically described below.

In the lower diagram in FIG. 14 illustrating an example of the advanced state, the sheet-shaped low frictional resistance members 50 are disposed with a shape in which the low frictional resistance members 50 extended towards the outside of the medium mount region K from fixed ends F1 fixed to the rotation shafts 51 are curved and free end F2 sides are advanced to the first regions M.

By having the low frictional resistance members 50 be brought to the advanced state while the sheet-shaped low frictional resistance member 50 are in a curved state, the low frictional resistance members 50 can be configured so that the free end F2 sides are elastically advanced to the first regions M. Accordingly, curling and lifting up of the medium P mounted under the low frictional resistance members 50 can be suppressed more reliably.

As illustrated in FIG. 9, in the present embodiment, the first regions M are disposed in the end portions on both sides of the medium mount region K in the width direction. In other words, the low frictional resistance members 50*a* and 50*b* in the advanced state are disposed on the end portions on both sides of the medium mount region K in the width direction. Since the low frictional resistance members 50*a* and 50*b* in the advanced state hold down both end portions of the medium P, which has been discharged to the first tray 35, in the width direction, curling of the medium P in the width direction can be suppressed effectively. Furthermore, components that switch the low frictional resistance members 50*a* and 50*b* between the advanced state and the retracted state are disposed easily.

Figure 8:
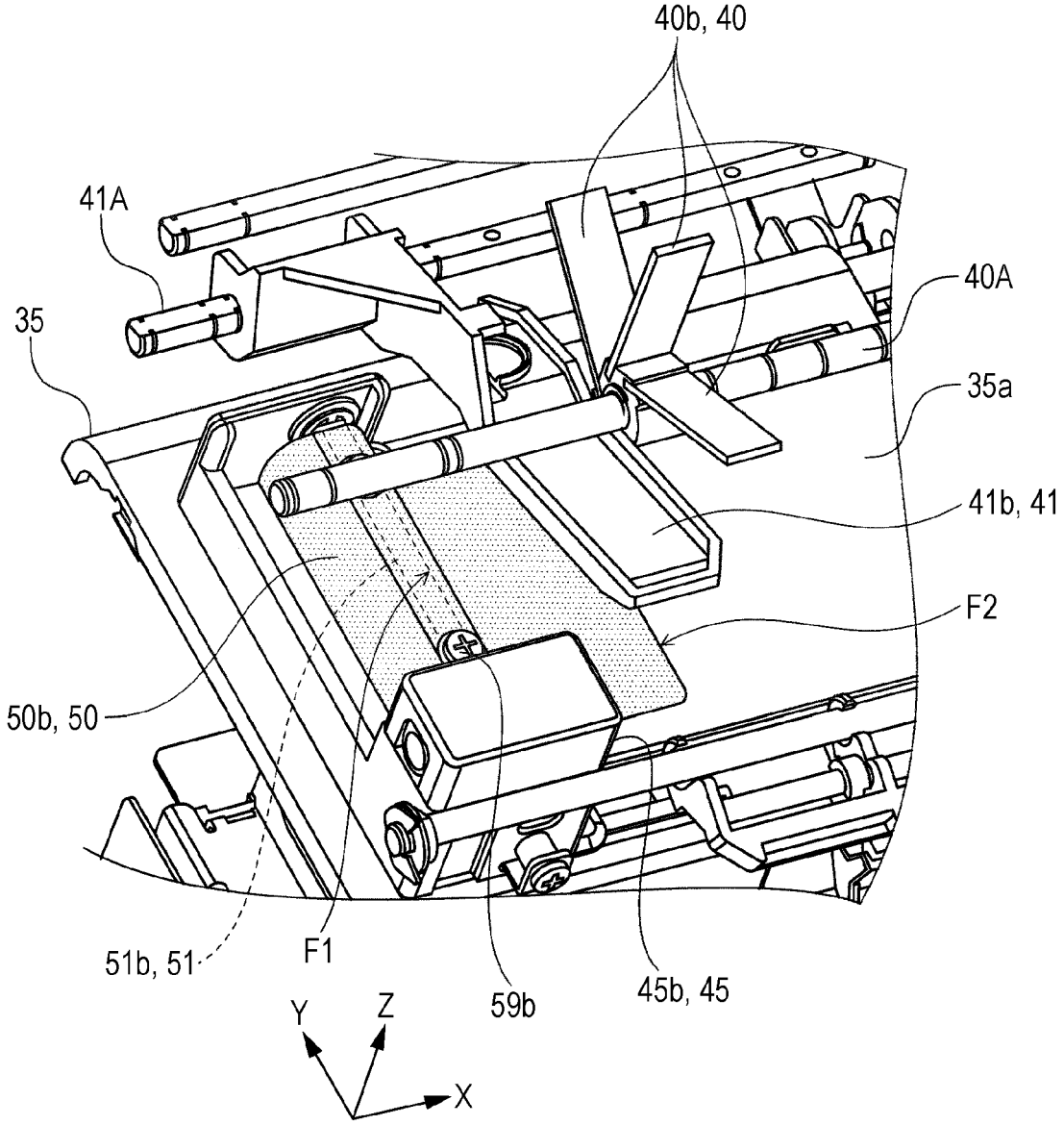
FIG. 8 is a perspective view illustrating the essential portion of the medium transporting apparatus in an enlarged manner.

The rotation shafts 51 to which the low frictional resistance members 50 are attached are, as illustrated in FIG. 8, disposed in a direction extending in the discharge direction. Furthermore, the rotation shafts 51*a* and 51*b* are attached to the first matching portion 45*a* and the second matching portion 45*b*. As illustrated in FIG. 9, the rotation shaft 51*a* of the low frictional resistance member 50*a* is fixed to the first matching portion 45*a*, and the rotation shaft 51*b* of the low frictional resistance member 50*b* is fixed to the second matching portion 45*b*. As illustrated in FIG. 8, the fixed end F1 of the low frictional resistance member 50*b* is fixed to the rotation shaft 51*b* with fixing members 59*b* such as screws or the like. Similar to the low frictional resistance member 50*b*, the first matching portion 45*a* is fixed to the rotation shaft 51*a* with fixing members 59*a* (FIG. 7).

The first matching portion 45*a* and the second matching portion 45*b* are configured to move to positions corresponding to the width size of the medium P. As illustrated in FIG. 10, the first matching portion 45*a* and the second matching portion 45*b* are provided on base portions 47*a* and 47*b* configured to move in the width direction by being guided by guide grooves 46*a* and 46*b* provided so as to extend in the width direction. The first matching portion 45*a* and the second matching portion 45*b* are moved by receiving motive power from a first motor 61*a* and a second motor 61*b* described later.

In the above, since the rotation shafts 51*a* and 51*b* are attached to the first matching portion 45*a* and the second matching portion 45*b* that move according to the size of the medium P in the width direction, the low frictional resistance members 50*a* and 50*b* can be made to move by following the movement of the first matching portion 45*a* and the second matching portion 45*b*. With the above, the low frictional resistance members 50*a* and 50*b* can be disposed at the end portions of the medium P in the width direction.

The switching of the low frictional resistance members 50 between the retracted state and the advanced state performed by rotating the rotation shafts 51 will be described next.

The retracted state of the low frictional resistance members 50 are illustrated in the upper drawing in FIG. 14. In the above state, the phase of the rotation shafts 51 is denoted as $\alpha 0$. In bringing the low frictional resistance members 50 to the advanced state, the rotation shaft 51*a* of the low frictional resistance member 50*a* located on the +X side is rotated clockwise in FIG. 14, and the rotation shaft 51*b* of the low frictional resistance member 50*b* located on the −X side is rotated counterclockwise.

The upper drawing and the middle drawing in FIG. 14 both depict the advanced state of the low frictional resistance members 50. The phases of the rotation shafts 51*a* and 51*b* are different between the middle drawing and the lower drawing in FIG. 14. In the middle drawing in FIG. 14, the phases of the rotation shafts 51*a* and 51*b* are in a state of phase $\alpha 1$ that is, in the rotation direction, close to phase $\alpha 0$ that is a phase when in the retracted state illustrated in the upper drawing in FIG. 14. In the lower drawing in FIG. 14, the phases of the rotation shafts 51*a* and 51*b* are in a state of phase $\alpha 2$ that is farther away from phase $\alpha 0$ (the upper drawing in FIG. 14) than phase $\alpha 1$ (the middle drawing in FIG. 14) in the rotation direction.

Curvatures of the curves of the low frictional resistance members 50*a* and 50*b* when the phases of the rotation shafts 51*a* and 51*b* are phase $\alpha 2$ (the lower drawing in FIG. 14) are larger than curvatures of the curves of the low frictional resistance members 50*a* and 50*b* when the phases of the rotation shafts 51*a* and 51*b* are phase α1 (the middle drawing in FIG. 14); accordingly, due to the elasticities of the curves, the pressing force of the free ends F2 of the low frictional resistance members 50 in the first regions M is larger in the state illustrated in the lower drawing in FIG. 14 than the state illustrated in the middle drawing in FIG. 14. By changing the rotation phases of the rotation shafts 51*a* and 51*b* in the advanced state, the pressing force applied to the first regions M with the free ends F2 of the low frictional resistance members 50 can be changed.

The rotation phases of the rotation shafts 51*a* and 51*b* in the advanced state can be controlled with a control unit 60 (FIG. 12) provided in the processing unit 4. The control unit 60 controls the rotations of the rotation shafts 51*a* and 51*b* by controlling a sheet motor 52 that is a drive source that rotates the rotation shafts 51*a* and 51*b*. Note that the control of the rotation shafts 51*a* and 51*b* can be performed with, for example, the control unit 15 that is provided in the recording unit 2 illustrated in FIG. 1 and that controls the recording system 1. A configuration that transmits the motive power from the sheet motor 52 to the rotation shafts 51*a* and 51*b* will be described later.

Timings at which the retracted state (FIG. 10) and the advanced state (FIG. 11) of the low frictional resistance members 50 are switched will be described next.

In the present embodiment, the low frictional resistance members 50 are switched to the advanced state (FIG. 11) from the retracted state (FIG. 10) after the first medium P1 has been mounted on the first tray 35 and after the trailing edge E1 and both end portions in the width direction have been matched. Accordingly, the second medium P2 that is discharged subsequent to the first medium P1 from the pair of discharge rollers 33 is, as illustrated in FIG. 11, discharged on the low frictional resistance members 50 that is in the advanced state and that is on the first medium P1.

In other words, when the second medium P2 discharged from the pair of discharge rollers 33 after the first medium P1 had been discharged is moved towards the upstream end matching members 38 with the paddles 40, the low frictional resistance members 50 are interposed between the first medium P1 and the second medium P2.

By interposing the low frictional resistance members 50 between the first medium P1 and the second medium P2, when moving the second medium P2 towards the upstream end matching members 38 with the paddles 40, the frictional resistance between the first medium P1 and the second medium P2 is reduced and it will be easier to move the second medium P2 with the paddles 40. Accordingly, it will be possible to abut the second medium P2 against the upstream end matching members 38 in a more reliable manner, and matching of the end portion of the medium can be performed appropriately.

When the frictional resistance between the first medium P1 and the mount surface 35*a* of the first tray 35 is smaller than the frictional resistance between the mediums P, the low frictional resistance members 50 may be in the retracted state when the first medium P1 is mounted as the first sheet on the first tray 35. Note that the first tray 35 can be formed of resin, metal, or the like.

Furthermore, after the second medium P2 has been moved with the paddles 40, the low frictional resistance members 50 are temporarily switched from the advanced state to the retracted state and, then, are switched to the advanced state positioned above the second medium P2. In the present embodiment, after the second medium P2 is moved with the paddles 40 and before the matching operation is performed on the second medium P2 with the width direction matching members 45, the low frictional resistance members 50 are temporarily switched from the advanced state to the retracted state and, then, are switched to the advanced state positioned above the second medium P2.

Since the low frictional resistance members 50 are disposed on the second medium P2 after the trailing edge E1 of the second medium P2 has been matched, curling and lifting up of the second medium P2 can be suppressed.

Particularly, when the end portions of the medium P in the width direction are curled when the matching operation is performed with the width direction matching members 45 (the first matching portion 45*a* and the second matching portion 45*b*), the matching of the medium P in the width direction may become insufficient. In the present embodiment, since the low frictional resistance members 50 are switched to the advanced state positioned above the second medium P2 before the matching operation in the width direction is performed on the second medium P2 with the width direction matching members 45, when the matching operation is performed with the width direction matching members 45, curling of the second medium P2 is held down and matching in the width direction can be performed appropriately.

Furthermore, as illustrated in the upper drawing in FIG. 5, the first regions M according to the present embodiment each include the position where the leading edge E2 of the second medium P2 in the discharge direction first comes in contact with the first medium P1 when the second medium P2 is discharged from the pair of discharge rollers 33. In the upper drawing in FIG. 5, the positions G1 and G2 that are examples of the landing position of the second medium P2 on the first tray 35 are included in the first region M. Note that while the reference signs G1 and G2 depicted in the upper drawing in FIG. 5 are the landing positions of the first medium P1, when the first medium P1 and the second medium P2 are of the same type, the landing positions of the second medium P2 discharged subsequent to the first medium P1 are substantially the same as that of the first medium P1; accordingly, it is assumed that the reference signs G1 and G2 are the landing positions of the second medium P2.

The position G2 is the landing position when the stiffness of the medium P is high and the medium P moves straight in the discharge direction without hanging down. The position G1 indicates the landing position of the medium P having a stiffness lower than the above.

When the second medium P2 is discharged on the first medium P1, after the leading edge E2 of the second medium P2 in the discharge direction has landed on the first medium P1, the second medium P2 moves in the discharge direction on the first medium P1 until the trailing edge E1 in the discharge direction is separated from the pair of discharge rollers 33.

Note that when the frictional resistance between the first medium P1 and the second medium P2 is large, moving of the leading edge E2 of the second medium P2, which has landed on the first medium P1, in the discharge direction may be hindered by the frictional resistance between the mediums and there are cases in which the second medium P2 is not appropriately mounted on the first tray 35.

By having the landing position (for example, the position G1 or the position G2) of the leading edge E2 of the second medium P2 be included in the first regions M, the second medium P2 can, after the leading edge E2 has landed, move on the low frictional resistance members 50 in the discharge direction. Since the frictional resistance between the low frictional resistance members 50 and the second medium P2 is lower than the frictional resistance between the first medium P1 and the second medium P2, incidents such as the leading edge E2 of the second medium P2 that has landed becoming caught can be reduced; accordingly, the second medium P2 can be appropriately mounted on the first tray 35.

Furthermore, the rotation phases of the rotation shafts 51 can be controlled according to the number of mediums P mounted on the first tray 35. The rotation phases of the rotation shafts 51 are, as described above, controlled by the control unit 60.

When the number of mediums P on the first tray 35 increases, the position of the uppermost medium P becomes high. As in the present embodiment, when the sheet-shaped low frictional resistance members 50 are brought to the advanced state by being curved, if the mediums P are mounted on the first tray 35 while the rotation phases of the rotation shafts 51 are fixed to $\alpha 2$ illustrated in the lower drawing in FIG. 14, the free ends F2 of the low frictional resistance members 50 are pushed up and the curvatures of the curves become larger as the number of the mounted sheets increases. Accordingly, the pressing force applied to the mediums P by the low frictional resistance members 50 becomes large. When the pressing force applied to the mediums P by the low frictional resistance members 50 becomes large, there are cases in which the uppermost medium P with which the low frictional resistance members 50 are in contact becomes damaged. Furthermore, when the curvatures of the curves of the low frictional resistance members 50 become large due to the increase in the number of mounted sheets, the free ends F2 of the low frictional resistance members 50 become oriented upwards and the adhesion between the low frictional resistance members 50 and the uppermost medium P decreases. If the low frictional resistance members 50 and the uppermost medium P are not in surface contact with each other, the medium subsequently mounted may become caught. Furthermore, if a state in which the low frictional resistance members 50 are curved with large curvatures continue, the low frictional resistance members 50 may develop a tendency of being curved.

In the present embodiment, the control unit 60 can control the rotation phases of the rotation shafts 51 so that pressing force from the low frictional resistance members 50 is reduced in accordance with the increase in the number of mounted mediums P. For example, by changing the state illustrated in the lower drawing in FIG. 14 in which the phases of the rotation shafts 51 are $\alpha 2$ to the state illustrated in the middle drawing in FIG. 14 in which the phases are $\alpha 1$, which is smaller than the curvatures of the curves of the low frictional resistance members 50 in the lower drawing in FIG. 14, the pressing force of the low frictional resistance members 50 that has increased due to the increase in the number of mounted mediums P can be reduced. With the above, regardless of the number of mounted mediums P, the change in the pressing force applied to the mediums P with the low frictional resistance members 50 in the advanced state can be made small.

Furthermore, the free ends F2 of the low frictional resistance members 50 can be prevented from being oriented upwards as the number of mounted mediums P increases, and the low frictional resistance members 50 and the uppermost medium P can be adhered to each other. Accordingly, the subsequent medium P can be prevented from being caught by the low frictional resistance members 50. Furthermore, the possibility of the low frictional resistance members 50 developing a tendency to become curved can be reduced.

Figure 12:
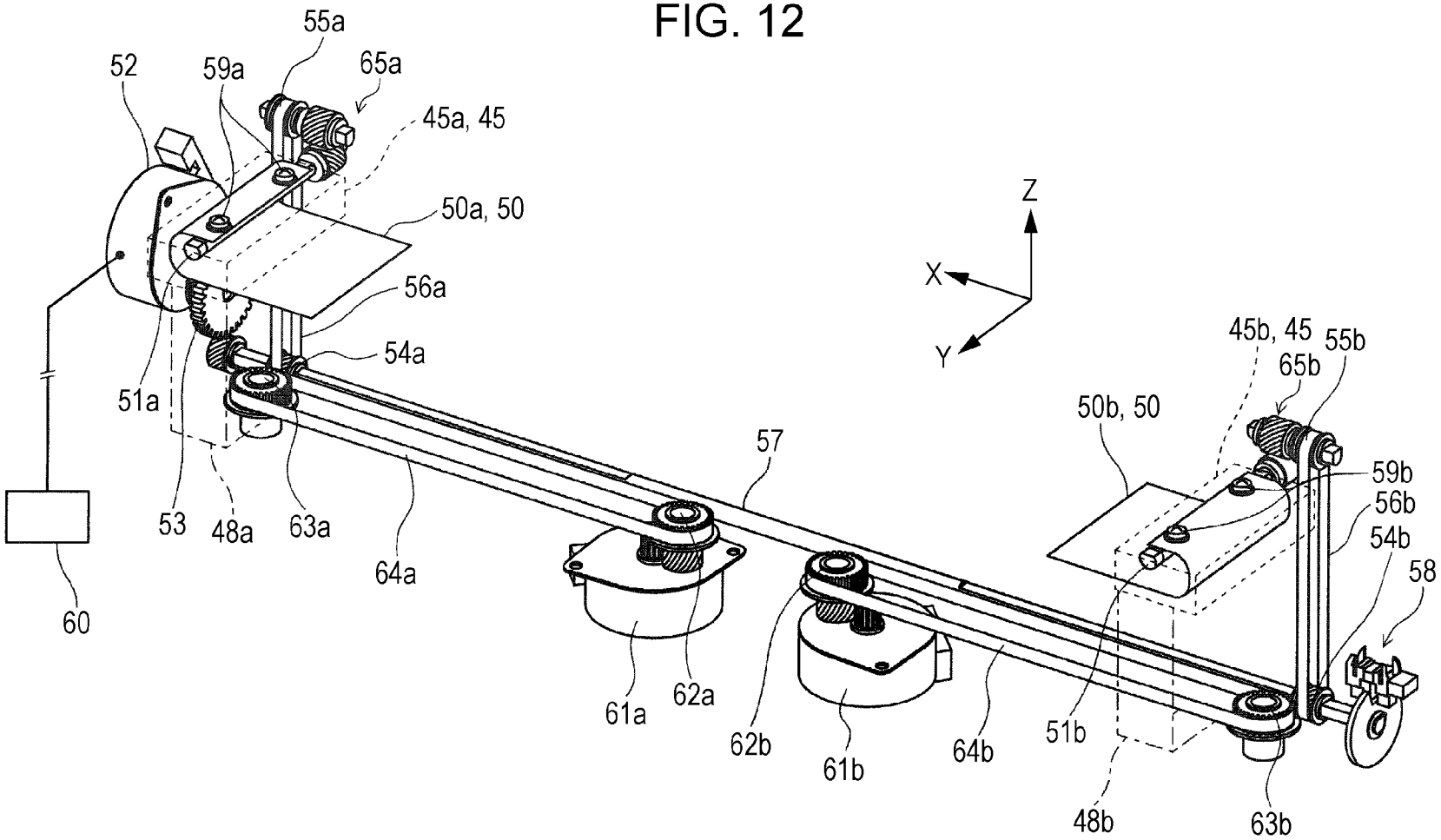
FIG. 12 is a perspective view illustrating a drive mechanism of the low frictional resistance members and a moving mechanism of width direction matching members.

Referring next to FIG. 12, a drive mechanism of the low frictional resistance members 50*a* and 50*b* that are switched between the advanced state and the retracted state, and a moving mechanism of the width direction matching members 45 (the first matching portion 45*a* and the second matching portion 45*b*) that move in the width direction will be described.

Regarding Drive Mechanism of Low Frictional Resistance Members

The advanced state and the retracted state of the low frictional resistance members 50*a* and 50*b* are switched by rotating the rotation shafts 51*a* and 51*b* with the motive power of the sheet motor 52. The rotation of the sheet motor 52 is transmitted to a first shaft portion 57 through a gear 53 serving as a motive power transmission mechanism. The first shaft portion 57 is provided so as to extend in the X-axis direction that is the width direction, and a lower pulley 54*a* is provided on the +X side and a lower pulley 54*b* is provided on the −X side. The lower pulley 54*a* and the lower pulley 54*b* rotate about the first shaft portion 57. An upper pulley 55*a* and an upper pulley 55*b* are provided above the lower pulley 54*a* and the lower pulley 54*b*, respectively. An endless belt 56*a* is stretched around the lower pulley 54*a* and the upper pulley 55*a*, and an endless belt 56*b* is stretched around the lower pulley 54*b* and the upper pulley 55*b*. The rotations of the lower pulleys 54*a* and 54*b* are transmitted to the upper pulleys 55*a* and 55*b* through the endless belts 56*a* and 56*b*. Furthermore, the rotations are transmitted from the upper pulleys 55*a* and 55*b* to the rotation shafts 51*a* and 51*b* through crossed helical gears 65*a* and 65*b*.

A phase detection member 58 that detects the rotation phase of the first shaft portion 57 is provided in an end portion of the first shaft portion 57 on the −X side. Information on the phases of the rotation shafts 51*a* and 51*b* can be obtained based on the detection result of the phase detection member 58.

The control unit 60 controls the drive of the sheet motor 52 based on the detection result of the medium P with the medium detection member 39 illustrated in FIG. 2 and on information on the phases of the rotation shafts 51*a* and 51*b* based on the detection result of the phase detection member 58. With the above, the control of the timing at which the advanced state and the retracted state of the low frictional resistance members 50*a* and 50*b* are switched, and the control of the pressing force of the low frictional resistance members 50*a* and 50*b* in the advanced state performed by controlling the phases of the rotation shafts 51*a* and 51*b* can be performed.

Regarding Moving Mechanism of Width Direction Matching Members

In the present embodiment, the first matching portion 45*a* and the second matching portion 45*b* are driven by discrete drive sources. The first matching portion 45*a* is driven by the first motor 61*a*, and the second matching portion 45*b* is driven by the second motor 61*b*. The first motor 61*a* and the second motor 61*b* are each disposed at a position near the center in the width direction.

The moving mechanism of the first matching portion 45*a* includes a driving pulley 62*a* that rotates by receiving motive power from the first motor 61*a*, a driven pulley 63*a* provided away from the driving pulley 62*a* in the +X direction, and an endless belt 64*a* stretched around the driving pulley 62*a* and the driven pulley 63*a*. The first matching portion 45*a* is attached to the endless belt 64*a* through an attaching portion 48*a*. The first motor 61*a* is configured to rotate both in a positive rotation direction and a reverse rotation direction. The moving direction of the endless belt 64*a* can be switched by changing the rotation direction of the first motor 61*a*. With such a configuration, the first matching portion 45*a* can be moved in the X-axis direction.

The moving mechanism of the second matching portion 45*b* includes a driving pulley 62*b*, a driven pulley 63*b*, an endless belt 64*b*, and an attaching portion 48*b* that correspond to the driving pulley 62*a*, the driven pulley 63*a*, the endless belt 64*a*, and the attaching portion 48*a* of the moving mechanism of the first matching portion 45*a*. The configuration thereof is similar to that of the first matching portion 45*a*; accordingly, a detailed description thereof is omitted.

In the present embodiment, while the first matching portion 45*a* and the second matching portion 45*b* are driven by different drive sources, the first matching portion 45*a* and the second matching portion 45*b* can both be moved by a belt mechanism driven by a single drive source. Furthermore, instead of the belt mechanism, for example, a rack and pinion mechanism may be used.

Furthermore, similar to the moving mechanism of the width direction matching members 45 described above with reference to FIG. 12, the moving mechanism that moves the guide members 41 (the guide members 41*a* and 41*b*) and the paddles 40 (the paddles 40*a* and 40*b*) in the width direction can be a belt mechanism including an endless belt stretched around pulleys, or can be a rack and pinion mechanism.

The width direction matching members 45, the guide members 41, and the paddles 40 can be operated with discrete drive sources. Alternatively, the width direction matching members 45, the guide members 41, and the paddles 40 can be operated with common drive sources. For example, the first matching portion 45*a*, the guide member 41*a*, and the paddle 40*a* can be operated with the motive power from the first motor 61*a*, and the second matching portion 45*b*, the guide member 41*b*, and the paddle 40*b* can be operated with the second motor 61*b*.

Figure 16:
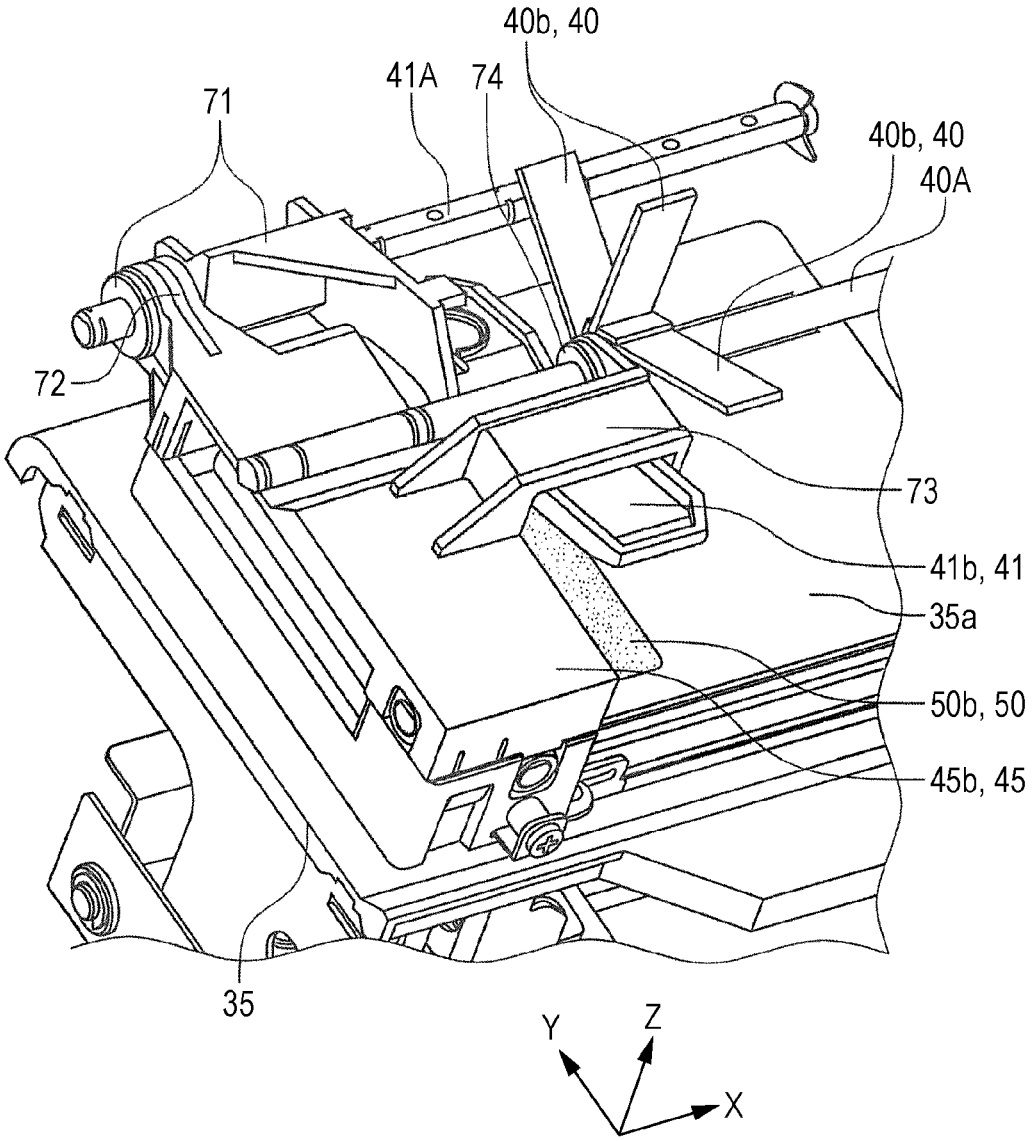
FIG. 16 is a perspective view illustrating an example of a configuration interlocking the guide member and the paddle with the movement of the width direction matching member.

Furthermore, as illustrated in FIG. 16, the guide member 41*b* and the paddle 40*b* can be fixed to the second matching portion 45*b* that moves in the width direction with the moving mechanism illustrated in FIG. 12 so that the guide member 41*b* and the paddle 40*b*, following the movement of the second matching portion 45*b*, are moved.

The second matching portion 45*b* includes a first coupling portion 72 and a second coupling portion 73. The first coupling portion 72 is coupled to a first coupled portion 71 of the guide member 41*b*. The second coupling portion 73 is coupled to the second coupled portion 74 of the paddle 40*b*. The first coupled portion 71 of the guide member 41*b* is attached to the pivot shaft 41A in a slidable manner. The second coupled portion 74 of the paddle 40*b* is attached to the rotation shaft 40A in a slidable manner.

With the above configuration, when the second matching portion 45*b* moves in the width direction, the guide member 41*b* and the paddle 40*b* can be moved integrally with the second matching portion 45*b*.

The first matching portion 45*a*, the guide member 41*a*, and the paddle 40*a* on the +X side, illustration of which is omitted in FIG. 16, can be configured in a similar manner to that of the second matching portion 45*b*, the guide member 41*b*, and the paddle 40*b* illustrated in FIG. 16.

In the above configuration, the guide members 41 and the paddles 40 can also be moved with the motive power of the first motor 61*a* and the second motor 61*b* that are drive sources of the width direction matching members 45.

Furthermore, the guide members 41 and the paddles 40 are configured to be switched to a state that is not interlocked with the movements of the width direction matching members 45 when the width direction matching members 45 perform the matching operation described with reference to FIG. 13.

The guide members 41 and the paddles 40 do not need to be moved in the width direction when the width direction matching members 45 perform the matching operation. If the guide members 41 and the paddles 40 are made to follow the movements of the width direction matching members 45 when the matching operation is performed, a large sound may be generated with the movement of the guide members 41 and the paddles 40. By switching to a state in which the guide members 41 and the paddles 40 are not interlocked with the movement of the width direction matching members 45, the operation sound while performing the matching operation can be reduced when the width direction matching members 45 perform the matching operation.

If the movements of the width direction matching members 45, the guide members 41, and the paddles 40 can be controlled independently, switching between interlocking and not interlocking the guide members 41 and the paddles 40 with the movements of the width direction matching members 45 can be performed easily.

Furthermore, in a configuration illustrated in FIG. 16 in which the guide members 41 and the paddles 40 are integrally coupled to and move with the width direction matching members 45, for example, a clearance space in the width direction can be provided between the first coupling portion 72 and the first coupled portion 71 and between the second coupling portion 73 and the second coupled portion 74 so that when the width direction matching members 45 have moved a predetermined distance or more in the width direction, the guide members 41 and the paddles 40 are coupled to the width direction matching members 45 so that the guide members 41 and the paddles 40 can move integrally with the width direction matching members 45.

Note that in the present embodiment, processing unit 4 can be comprehended as a "medium processing apparatus" that includes the medium transporting apparatus 30 and the processing portion 36 that performs a predetermined process on the medium mounted on the first tray 35. Furthermore, the recording system 1 can be comprehended a "medium processing apparatus" that includes the medium transporting apparatus 30 and the processing portion 36 that performs a predetermined process on the medium mounted on the first tray 35. Furthermore, an apparatus in which the recording function has been omitted from the recording system 1 can be comprehended as a "medium transporting apparatus". Alternatively, even provided with a recording function, when focusing on the viewpoint of medium transportation, the recording system 1 itself can be regarded as a medium transporting apparatus.

Furthermore, the low frictional resistance members 50 can be configured so that the low frictional resistance members 50 are switched between the advanced state and the retracted state by being moved in a linear manner, for example.

Note that not limited to the embodiments described above, various modifications that are within the scope of the claims can be made. It goes without saying that the modifications are also included in the scope of the disclosure.

What is claimed is:

1. A medium transporting apparatus comprising:

a medium tray configured to hold a medium discharged from a discharge portion that discharges the medium;

a guide member configured to come in contact with the medium that has been discharged from the discharge portion, and that is configured to guide the medium to the medium tray; and a width direction matching member configured to match an end portion of the medium, which has been discharged on the medium tray, in a width direction that intersects a discharge direction of the medium, wherein the guide member and the width direction matching member are configured to move in the width direction in an interlocked manner, wherein the guide member is configured to switch between a retracted position that does not interrupt discharge of the medium discharged from the discharge portion and an advanced position in which the guide member is, relative to the retracted position, advanced in a direction approaching the medium tray, the guide member being positioned at the retracted position when the medium is transported in the discharge direction from the discharge portion and the guide member being displaced from the retracted position to the advanced position when the medium that has been discharged from the discharge portion is guided to the medium tray; and an upstream end matching member configured to match an upstream end portion of the medium, which has been discharged to the medium tray, in the discharge direction; and a paddle configured to come in contact with the medium, which has been discharged to the medium tray, and configured to rotate, the paddle moving the medium towards the upstream end matching member, wherein the paddle is configured to be interlocked with movements of the guide member and the width direction matching member moves in the width direction, wherein the width direction matching member, the guide member, and the paddle are provided on both sides with respect to a center in the width direction and are, in the width direction, disposed from an outside towards the center in an order of the width direction matching member, the guide member, and the paddle.

2. The medium transporting apparatus according to claim 1, wherein the width direction matching member is configured to perform a matching operation that matches an end portion of the medium in the width direction by moving from a first position that is positioned outside the medium, which is mounted on the medium tray, in the width direction to a second position that is positioned inside the first position in the width direction, and the guide member and the paddle are configured to be switched to a state in which the guide member and the paddle are not interlocked with the movement of the width direction matching member when the matching operation is performed.

* * * * *